US008754820B2

(12) United States Patent
Iwai et al.

(10) Patent No.: US 8,754,820 B2
(45) **Date of Patent: *Jun. 17, 2014**

(54) ANTENNA APPARATUS PROVIDED WITH ELECTROMAGNETIC COUPLING ADJUSTER AND ANTENNA ELEMENT EXCITED THROUGH MULTIPLE FEEDING POINTS

(75) Inventors: Hiroshi Iwai, Osaka (JP); Atsushi Yamamoto, Kyoto (JP); Tsutomu Sakata, Osaka (JP); Satoru Amari, Osaka (JP)

(73) Assignee: Panasonic Corporation, Osaka (JP)

( * ) Notice: Subject to any disclaimer, the term of this patent is extended or adjusted under 35 U.S.C. 154(b) by 1159 days.

This patent is subject to a terminal disclaimer.

(21) Appl. No.: 11/951,153

(22) Filed: Dec. 5, 2007

(65) Prior Publication Data

US 2008/0143613 A1 Jun. 19, 2008

(30) Foreign Application Priority Data

Dec. 5, 2006 (JP) ..... 2006-328198

(51) Int. Cl.
*H01Q 21/00* (2006.01)
*H01Q 1/24* (2006.01)

(52) U.S. Cl.
USPC ..... 343/725; 343/702

(58) Field of Classification Search
USPC ..... 343/702, 767, 850, 893, 770, 846, 725, 343/729
See application file for complete search history.

(56) References Cited

U.S. PATENT DOCUMENTS

| | | | | |
|---|---|---|---|---|
| 6,771,223 | B1 | 8/2004 | Shoji et al. | |
| 6,903,688 | B2 * | 6/2005 | Edvardsson | 343/700 MS |
| 7,289,068 | B2 * | 10/2007 | Fujio et al. | 343/700 MS |
| 7,460,069 | B2 * | 12/2008 | Park et al. | 343/700 MS |
| 7,629,930 | B2 * | 12/2009 | Murch et al. | 343/700 MS |
| 2005/0140549 | A1 * | 6/2005 | Leelaratne | 343/700 MS |
| 2007/0080872 | A1 | 4/2007 | Nishikido et al. | |
| 2007/0222701 | A1 * | 9/2007 | Yoon et al. | 343/895 |
| 2008/0106477 | A1 * | 5/2008 | Mashima et al. | 343/702 |
| 2008/0198082 | A1 * | 8/2008 | Soler Castany et al. | 343/770 |

FOREIGN PATENT DOCUMENTS

| | | |
|---|---|---|
| EP | 1 296 407 | 3/2003 |
| JP | 2005-130216 | 5/2005 |
| WO | 01/97325 | 12/2001 |
| WO | 02/39544 | 5/2002 |
| WO | WO2006001432 A * | 1/2006 |
| WO | 2006/120250 | 11/2006 |

* cited by examiner

*Primary Examiner* — Robert Karacsony
(74) *Attorney, Agent, or Firm* — Wenderoth, Lind & Ponack, LLP.

(57) ABSTRACT

An antenna apparatus includes a first feeding point and a second feeding point provided at respective positions on an antenna element. The antenna element is excited through the first and second feeding points simultaneously so as to operate as a first antenna portion and a second antenna portion simultaneously, the first antenna portion and the second antenna portion correspond to the first and second feeding points, respectively. The antenna element further includes, between the first and second feeding points, an electromagnetic coupling adjuster for making an amount of isolation between the first and second antenna portions.

16 Claims, 36 Drawing Sheets

ANTENNA APPARATUS PROVIDED WITH ELECTROMAGNETIC COUPLING ADJUSTER AND ANTENNA ELEMENT EXCITED THROUGH MULTIPLE FEEDING POINTS

BACKGROUND OF THE INVENTION

1. Field of the Invention

The present invention relates to an antenna apparatus provided with a single antenna element which is excited through a plurality of feeding points, and with an electromagnetic coupling adjuster, and relates to a wireless communication apparatus including this antenna apparatus. More particularly, the present invention relates to an antenna apparatus, e.g., for mobile communication, and relates to a wireless communication apparatus including this antenna apparatus.

2. Description of the Related Art

The size and thickness of portable wireless communication apparatuses, such as mobile phones, has been rapidly reduced. Portable wireless communication apparatuses have been transformed from apparatuses to be used only as conventional telephones, to data terminals for transmitting and receiving electronic mails and for browsing web pages of WWW (World Wide Web). Further, since the amount of information to be handled has increased from that of conventional audio and text information to that of pictures and videos, a further improvement in communication quality is required. In such circumstances, an antenna apparatus capable of switching among directivities has been proposed.

PCT International Publication WO02/39544 discloses an antenna device including a rectangular conductive board, and a flat plate antenna mounted on the board with a dielectric interposing therebetween. The antenna device is characterized by exciting the antenna in a certain direction so as to flow a current through the board in one diagonal direction, and exciting the antenna in a different direction so as to flow a current through the board in the other diagonal direction. As such, in the antenna device disclosed in PCT International Publication WO02/39544, the directivity and polarization direction of the antenna device can be changed by varying the direction of a current flowing through the board.

Japanese Patent Laid-Open Publication No. 2005-130216 discloses a mobile radio apparatus that is foldable and that has a mechanism joining a first case and a second case at a hinge part allowing the mobile radio apparatus to open and close. The mobile radio apparatus includes: a first flat conductor placed on a first plane inside the first case along a longitudinal direction of the first case, and a second flat conductor and a third flat conductor placed on a second plane opposing a first plane inside the first case along the longitudinal direction of the first case, and feeding means for feeding the first flat conductor and feeding selectively the second flat conductor or the third flat conductor at a phase different from a phase with which the first flat conductor is fed. The mobile wireless apparatus disclosed in Japanese Patent Laid-Open Publication No. 2005-130216 can improve communication performance by switching between the second and third flat conductors in response to a reduction in reception level.

PCT International Publication WO01/97325 discloses a portable radio unit including a dipole antenna, and two feeding means each connected to one of two antenna elements that compose the dipole antenna.

Recently, an antenna apparatus has appeared that adopts MIMO (Multi-Input Multi-Output) technology for simultaneously transmitting and/or receiving radio signals of a plurality of channels by space division multiplexing, in order to increasing communication capacity and achieve high-speed communication. The antenna apparatus that performs MIMO communication needs to simultaneously transmit and/or receive a plurality of radio signals with low correlation to each other, each having a different directivity, polarization characteristics, or the like, in order to achieve the space division multiplexing. The antenna device disclosed in PCT International Publication WO02/39544 can switch over to a different directivity, however, this antenna device cannot simultaneously implement a plurality of states, each having a different directivity. The mobile radio apparatus disclosed in Japanese Patent Laid-Open Publication No. 2005-130216 requires a plurality of antenna elements (flat conductors), and results in a complicated structure. Furthermore, in a similar manner to that of the antenna device disclosed in PCT International Publication WO02/39544, although this mobile radio apparatus can switch over to a different directivity, this mobile radio apparatus cannot simultaneously implement a plurality of states, each having a different directivity. The portable radio unit disclosed in PCT International Publication WO01/97325 cannot switch between directivities, and also cannot simultaneously implement a plurality of states, each having a different directivity.

SUMMARY OF THE INVENTION

An object of the present invention is therefore to solve the above mentioned problems, and provide an antenna apparatus capable of simultaneously transmitting and/or receiving a plurality of radio signals with low correlation to each other, while having a simpler configuration than that of prior art, and providing a wireless communication apparatus including this antenna apparatus.

According to a first aspect of the present invention, an antenna apparatus includes a first feeding point and a second feeding point provided at respective positions on an antenna element. The antenna element is excited through the first and second feeding points simultaneously so as to operate as a first antenna portion and a second antenna portion simultaneously, the first antenna portion and the second antenna portion correspond to the first and second feeding points, respectively. The antenna element comprises, between the first and second feeding points, an electromagnetic coupling adjuster for making an amount of isolation between the first and second antenna portions.

In the antenna apparatus, the electromagnetic coupling adjuster is a non-excitation slit formed in the antenna element.

Moreover, in the antenna apparatus, the electromagnetic coupling adjuster is a stub conductor provided to the antenna element.

Further, in the antenna apparatus, the antenna element has at least one excitation slit, and the second feeding point is provided along the excitation slit. The antenna element is excited as an electric current antenna through the first feeding point, and at the same time, the excitation slit is excited as a magnetic current antenna through the second feeding point.

Furthermore, in the antenna apparatus, the excitation slit has an open end on a periphery of the antenna element.

Moreover, in the antenna apparatus, when the antenna element is excited as an electric current antenna, a radio signal is fed to the antenna element through a capacitor.

Further, in the antenna apparatus, the first and second feeding points are provided on the antenna element so as to be spatially spaced apart from each other by an odd multiple of ¼ wavelength of radio signals transmitted and/or received by the antenna apparatus.

Furthermore, in the antenna apparatus, the antenna apparatus transmits and/or receives a plurality of different radio signals by exciting the antenna element through the first and second feeding points simultaneously.

Moreover, in the antenna apparatus, the plurality of different radio signals are a plurality of channel signals transmitted and received using a MIMO communication method.

Further, the antenna apparatus further comprises a ground conductor connected to the antenna element.

According to a second aspect of the present invention, a wireless communication apparatus transmits and/or receives a plurality of radio signals using an antenna apparatus, the antenna apparatus includes an antenna element, and a first feeding point and a second feeding point provided at respective positions on an antenna element. The antenna element is excited through the first and second feeding points simultaneously so as to operate as a first antenna portion and a second antenna portion simultaneously, the first antenna portion and the second antenna portion correspond to the first and second feeding points, respectively. The antenna element comprises, between the first and second feeding points, an electromagnetic coupling adjuster for making an amount of isolation between the first and second antenna portions.

As described above, according to the antenna apparatus and wireless communication apparatus of the present invention, an antenna apparatus and a wireless communication apparatus can be provided that are capable of simultaneously transmitting and/or receiving a plurality of radio signals with low correlation to each other, while having a simple configuration.

According to the present invention, while reducing the number of antenna elements to one, it is possible to excite this antenna element as multiple antenna portions, and also to ensure isolation between these multiple antenna portions. The most important effects provided by the present invention include that the isolation between multiple antenna portions is ensured even when exciting a single antenna element through a plurality of feeding points simultaneously so that the antenna element operates as the multiple antenna portions; that the correlation coefficient between radio signals (electromagnetic waves) transmitted and/or received by the respective antenna portions can be reduced because the radio signals transmitted and/or received by the respective antenna portions have different polarizations; and that no degeneration occurs even when the antenna element has a symmetric structure, because different feeding methods (current feeding and voltage feeding) are used; and accordingly, each antenna portion operates well.

According to the antenna apparatus and wireless communication apparatus of the present invention, the isolation between the antenna portions can be improved, by further including an electromagnetic coupling adjuster.

Thus, in an antenna apparatus including a single antenna element, it becomes possible, for example, to transmit and/or receive radio signals of a plurality of channels using to a MIMO communication method, to simultaneously perform wireless communications for a plurality of applications, or to simultaneously perform wireless communications in a plurality of frequency bands.

BRIEF DESCRIPTION OF THE DRAWINGS

Various objects, features, and advantages of the present invention will be disclosed as preferred embodiments which are described below with reference to the accompanying drawings.

DETAILED DESCRIPTION OF THE PREFERRED EMBODIMENTS

Figure 1:
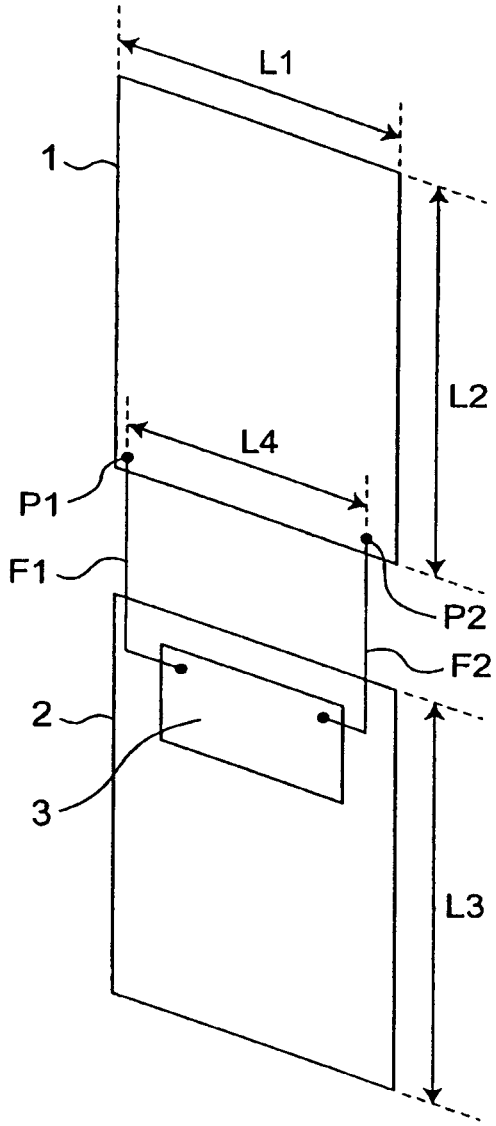
FIG. 1 is a perspective view showing a schematic configuration of an antenna apparatus according to a first preferred embodiment of the present invention.

Preferred embodiments according to the present invention will be described below with reference to the drawings. Note that in the drawings the same reference numerals denote like components.

First Preferred Embodiment

FIG. 1 is a perspective view showing a schematic configuration of an antenna apparatus according to a first preferred embodiment of the present invention. The antenna apparatus of the present preferred embodiment is characterized in that it includes a rectangular antenna element 1 having two different feeding points P1 and P2, and makes the single antenna element 1 operate as two antenna portions, by exciting the antenna element 1 as a first antenna portion through the feeding point P1, and at the same time, exciting the antenna element 1 as a second antenna portion through the feeding point P2.

In FIG. 1, the antenna apparatus includes the antenna element 1 made of a rectangular conductive plate with a horizontal length L1×a vertical length L2, and a ground conductor 2 made of a rectangular conductive plate with a horizontal length L1×a vertical length L3. The antenna element 1 and the ground conductor 2 are juxtaposed to be spaced from each other by a certain distance, so that one side of the antenna element 1 and one side of the ground conductor 2 (in the present preferred embodiment, the sides with the length L1) are opposed to each other. On the antenna element 1, the two feeding points P1 and P2 are provided close to a side opposing to the ground conductor 2 (a bottom side of the antenna element 1), such that these feeding points P1 and P2 are spaced apart from each other by a distance LA. The feeding point P1 is connected to a radio signal processor circuit 3 through a feed line F1, and similarly, the feeding point P2 is connected to the radio signal processor circuit 3 through a feed line F2. Each of the feed lines F1 and F2 can be made of, for example, a coaxial cable with an impedance of 50Ω, and in this case, respective inner conductors of the coaxial cables connect the radio signal processor circuit 3 to the feeding points P1 and P2, and on the other hand, respective outer conductors of the coaxial cables are connected to the ground conductor 2. Although FIG. 1 shows that the radio signal processor circuit 3 is integrated with the ground conductor 2, the radio signal processor circuit 3 and the ground conductor 2 may be separately provided. The shape of the antenna element 1 is not limited to rectangular, but may be, e.g., polygonal, circular or elliptic.

The distance L4 between the feeding points P1 and P2 satisfies the following relation of expression (1):

$$L4=(1/4+n/2)\lambda \quad (1),$$

where λ denotes a wavelength of radio signals transmitted and/or received by the antenna apparatus, and n denotes an integer greater than or equal to 0.

In other words, the distance L4 between the feeding points P1 and P2 is an odd multiple of ¼ wavelength of radio signals transmitted and/or received by the antenna apparatus.

In the antenna apparatus of the present preferred embodiment with the above-described configuration, it is possible to make the single antenna element 1 operate as two antenna portions such that the antenna element 1 is excited as the first antenna portion through the feeding point P1, and at the same time, the antenna element 1 is excited as the second antenna portion through the feeding point P2. As such, while having a simple configuration, the antenna apparatus can simultaneously transmit and/or receive a plurality of radio signals.

Figure 2:
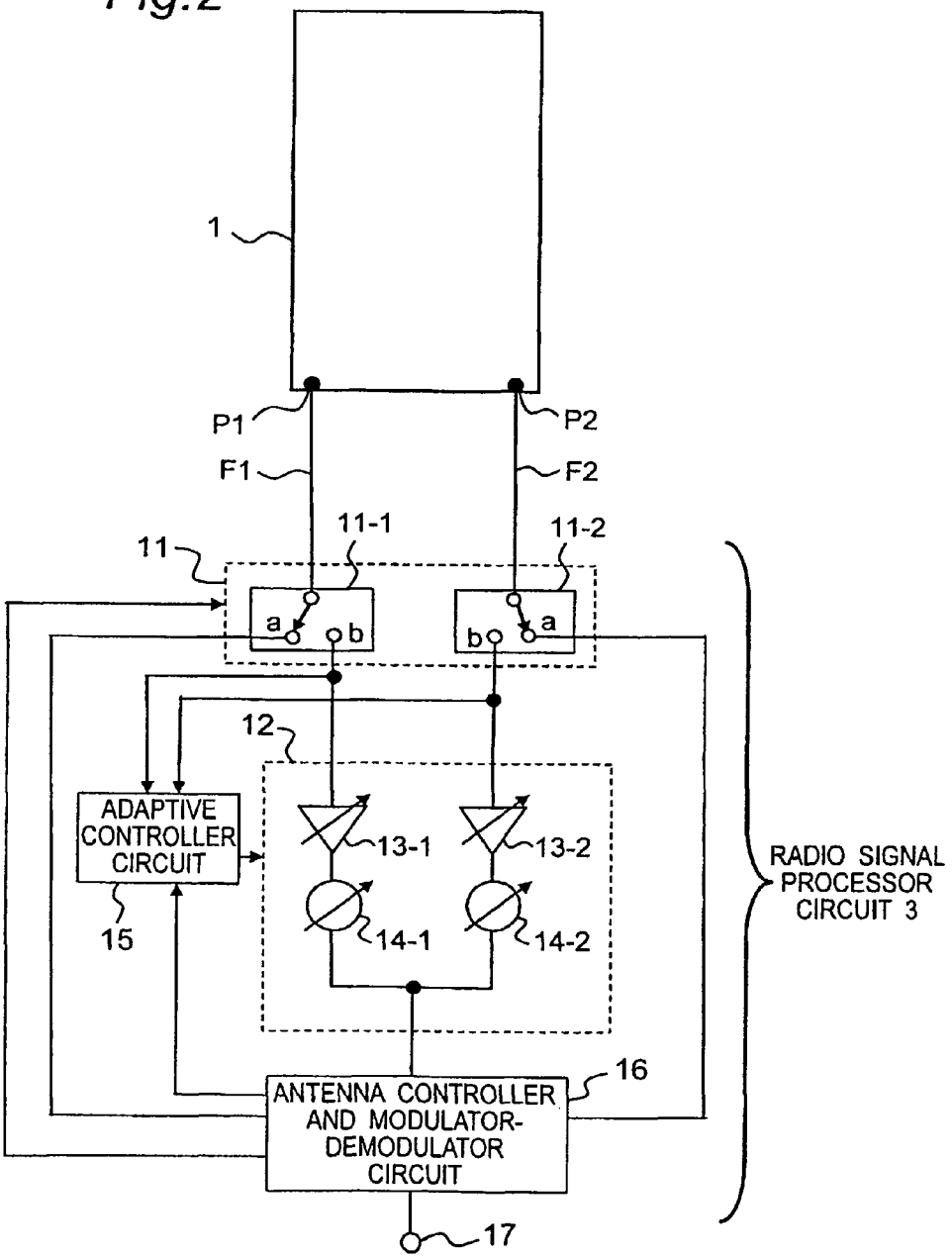
FIG. 2 is a block diagram showing a detailed configuration of a circuit of the antenna apparatus in FIG. 1.

FIG. 2 is a block diagram showing a detailed configuration of a circuit of the antenna apparatus in FIG. 1. The feeding points P1 and P2 of the antenna element 1 are respectively connected, through the feed lines F1 and F2, to switches 11-1 and 11-2 of a switch circuit 11 in the radio signal processor circuit 3. The switch circuit 11 switches, under control of an antenna controller and modulator/demodulator circuit 16, to either a state in which the antenna element 1 is directly connected to the antenna controller and modulator/demodulator circuit 16, or a state in which the antenna element 1 is connected to the antenna controller and modulator/demodulator circuit 16 through an amplitude and phase controller circuit 12. When the antenna element 1 is directly connected to the antenna controller and modulator/demodulator circuit 16, the antenna controller and modulator/demodulator circuit 16 operates as a MIMO modulator/demodulator circuit, and transmits and/or receives, through the antenna element 1, radio signals of a plurality of channels (in the present preferred embodiment, two channels) using a MIMO communication method. The antenna controller and modulator/demodulator circuit 16 may perform modulation or demodulation of two independent radio signals, instead of performing a MIMO modulation or demodulation, and in this case, the antenna apparatus of the present preferred embodiment can simultaneously perform wireless communications for a plurality of applications, or simultaneously perform wireless communications in a plurality of frequency bands. On the other hand, when the antenna element 1 is connected to the antenna controller and modulator/demodulator circuit 16 through the amplitude and phase controller circuit 12, the amplitude and phase controller circuit 12 performs adaptive control on transmitted and/or received radio signals under control of an adaptive controller circuit 15. The amplitude and phase controller circuit 12 includes amplitude adjusters 13-1 and 13-2, and phase shifters 14-1 and 14-2. Upon reception, each of signals received and respectively passed through the switches 11-1 and 11-2 is inputted to the amplitude and phase controller circuit 12 and inputted to the adaptive controller circuit 15. Preferably, for the purpose of maximum ratio combining, the adaptive controller circuit 15 determines the amounts of changes in amplitudes and amounts of phase shifts of the signals based on the inputted received signals, changes the amplitude and phase of the signal passed through the switch 11-1, by means of the amplitude adjuster 13-1 and the phase shifter 14-1, and changes the amplitude and phase of the signal passed through the switch 11-2, by means of the amplitude adjuster 13-2 and the phase shifter 14-2. The received signals whose amplitudes and phases have been changed are combined with each other, and the combined signal is inputted to the antenna controller and modulator/demodulator circuit 16. Upon transmission, in order to direct a beam in a desired direction, the adaptive controller circuit 15 determines the amounts of changes in amplitudes and amounts of phase shifts of signals to be transmitted under control of the antenna controller and modulator/demodulator circuit 16, and according to this determination, makes the amplitude and phase controller circuit 12 change the amplitudes and phases of the signals to be transmitted. The antenna controller and modulator/demodulator circuit 16 is connected, through an input/output terminal 17 of the radio signal processor circuit 3, to further circuits (not shown) in a wireless communication apparatus including the antenna apparatus of the present preferred embodiment.

Figure 4A:
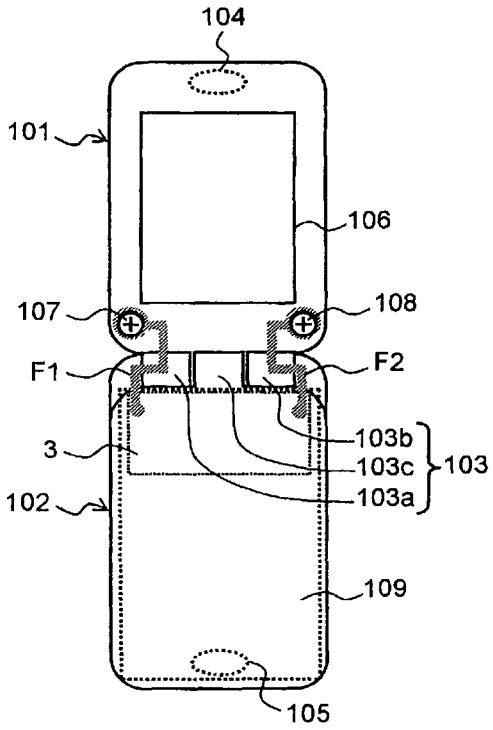
FIG. 4A is a front view of a mobile phone showing a first exemplary implementation of the antenna apparatus in FIG. 1.
Figure 4B:
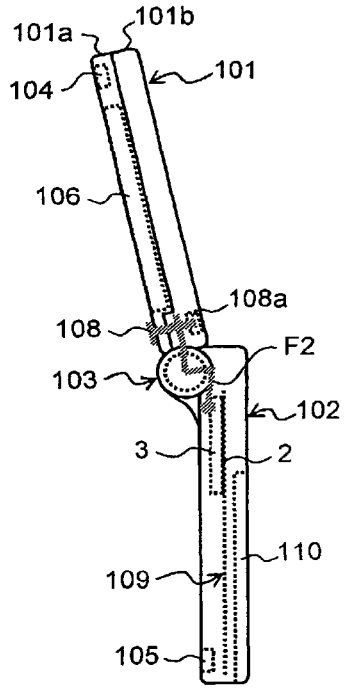
FIG. 4B is a side view of the mobile phone showing the first exemplary implementation of the antenna apparatus in FIG. 1.

FIG. 4A is a front view of a mobile phone showing a first exemplary implementation of the antenna apparatus in FIG. 1, and FIG. 4B is a side view thereof. In FIGS. 4A and 4B, the mobile phone of the present exemplary implementation includes an upper housing 101 and a lower housing 102, each being shaped in a substantially rectangular parallelepiped. The upper housing 101 and the lower housing 102 are connected to each other in a foldable manner through a cylindrical hinge portion 103. The upper housing 101 includes a first upper housing portion 101*a* located on a side close to a user during a telephone call using the mobile phone (in the following description, referred to as the "inner side" of the mobile phone), and a second upper housing portion 101*b* located on a side away from the user (hereinafter, referred to as the "outer side" of the mobile phone). The first upper housing portion 101*a* and the second upper housing portion 101*b* are secured at a left bottom portion of the inner side of the upper housing 101 by a screw 107 and a screw receiving portion (not shown), and secured at a right bottom portion of the inner side of the upper housing 101 by a screw 108 and a screw receiving portion 108*a*. In the present exemplary implementation, each of the first upper housing portion 101*a* and the second upper housing portion 101*b* is made of a conductor, and thus the upper housing 101 operates as the antenna element 1 in FIGS. 1 and 2. On the other hand, the lower housing 102 is made of a dielectric (e.g., plastic). The hinge portion 103 includes a left hinge portion 103*a* and a right hinge portion 103*b* which are mechanically connected to the first upper housing portion 101*a*, and includes a central hinge portion 103*c* which is integrally formed with the lower housing 102 and fits between the left hinge portion 103*a* and the right hinge portion 103*b*. The upper housing 101 and the lower housing 102 can be rotated about the hinge portion 103 by a rotating shaft (not shown) extending through the left hinge portion 103*a*, the central hinge portion 103*c* and the right hinge portion 103*b*, and thus can be folded. In addition, a display 106 is disposed at substantially the center of the first upper housing portion 101*a*, and a speaker 104 is disposed above the display 306. Furthermore, a microphone 105 is disposed on the inner side of the mobile phone and in the vicinity of a bottom end of the lower housing 102, and a rechargeable battery 110 is disposed on the opposite side of the microphone 105 (i.e., the outer side of the mobile phone) in the lower housing 102. A rectangular printed wiring board

109 is disposed within the lower housing 102 and at substantially the center in a thickness direction of the lower housing 102 (for ease of illustration, the representation of the thickness of the printed wiring board 109 is omitted). On the entire outer side surface of the printed wiring board 109 is formed a conductive pattern which acts as the ground conductor 2 in FIG. 1, on the other hand, on an inner side surface of the printed wiring board 109 is provided a radio signal processor circuit 3. A feed line F1 is made of a coaxial cable, extends from the radio signal processor circuit 3 to the upper housing 101 through the left hinge portion 103*a*, and is electrically connected to the left bottom portion of the first upper housing portion 101*a* by the screw 107. This connection point acts as the feeding point P1 of the antenna element 1. Similarly, a feed line F2 is also made of a coaxial cable, extends from the radio signal processor circuit 3 to the upper housing 101 through the right hinge portion 103*b*, and is electrically connected to the right bottom portion of the first upper housing portion 101*a* by the screw 108. This connection point acts as the feeding point P2 of the antenna element 1. The lower housing 102 may be made of a conductor, and in this case, the lower housing 102 instead of the printed wiring board 109 acts as the ground conductor 2.

Figure 5A:
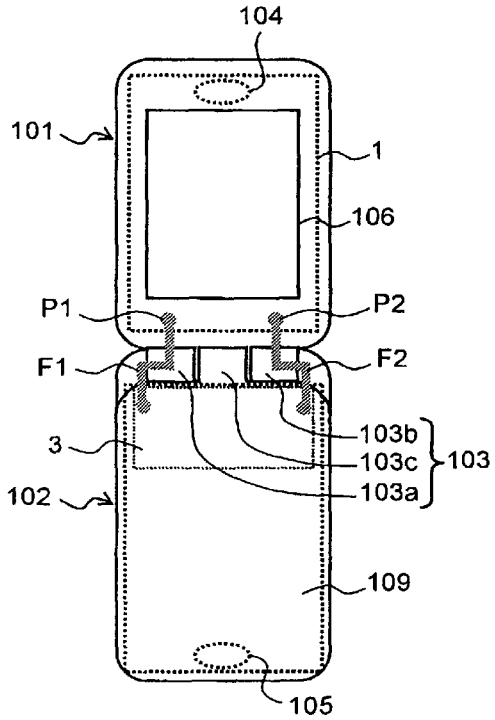
FIG. 5A is a front view of a mobile phone showing a second exemplary implementation of the antenna apparatus in FIG. 1.
Figure 5B:
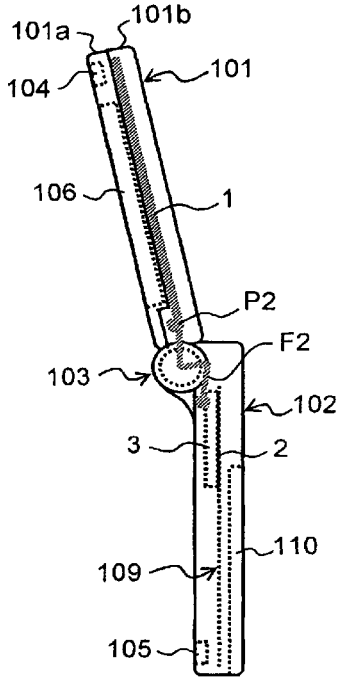
FIG. 5B is a side view of the mobile phone showing the second exemplary implementation of the antenna apparatus in FIG. 1.

FIG. 5A is a front view of a mobile phone showing a second exemplary implementation of the antenna apparatus in FIG. 1, and FIG. 5B is a side view thereof. The mobile phone of the present exemplary implementation is characterized in that each of a first upper housing portion 101*a* and a second upper housing portion 101*b* is made of a dielectric (e.g., plastic), and an antenna element 1 made of a rectangular conductive plate is provided within an upper housing 101. A feed line F1 is electrically connected to a feeding point P1 at a left bottom portion of the antenna element 1, and similarly, a feed line F2 is electrically connected to a feeding point P2 at a right bottom portion of the antenna element 1.

Figure 3:
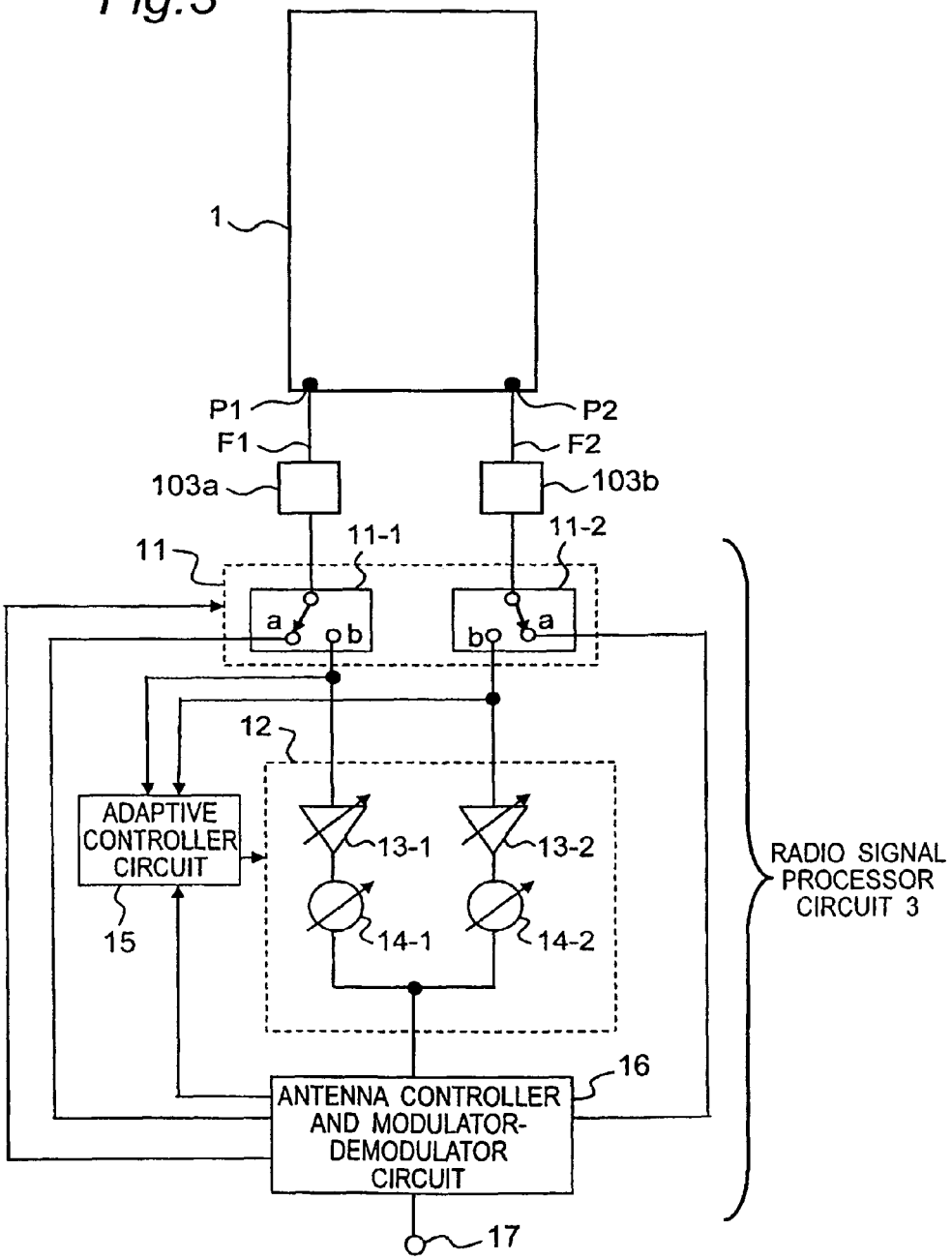
FIG. 3 is a block diagram showing a detailed configuration of a circuit of an antenna apparatus according to a modified preferred embodiment of the first preferred embodiment of the present invention.

FIG. 3 is a block diagram showing a detail configuration of a circuit of an antenna apparatus according to a modified preferred embodiment of the first preferred embodiment of the present invention. In the case that the antenna apparatus of the present preferred embodiment is provided to a foldable type mobile phone, such as those shown in FIGS. 4A, 4B, 5A and 5B, a left hinge portion 103*a* and a right hinge portion 103*b* of the mobile phone may be made of a conductive material such as aluminum or zinc, the left hinge portion 103*a* may be used as part of a feed line F1, and the right hinge portion 103*b* may be used as part of a feed line F2.

As described above, according to the antenna apparatus of the present preferred embodiment, it is possible to make the single antenna element 1 operate as two antenna portions, and accordingly, while having a simple configuration, the antenna apparatus can simultaneously transmit and/or receive a plurality of radio signals.

Second Preferred Embodiment

Figure 6:
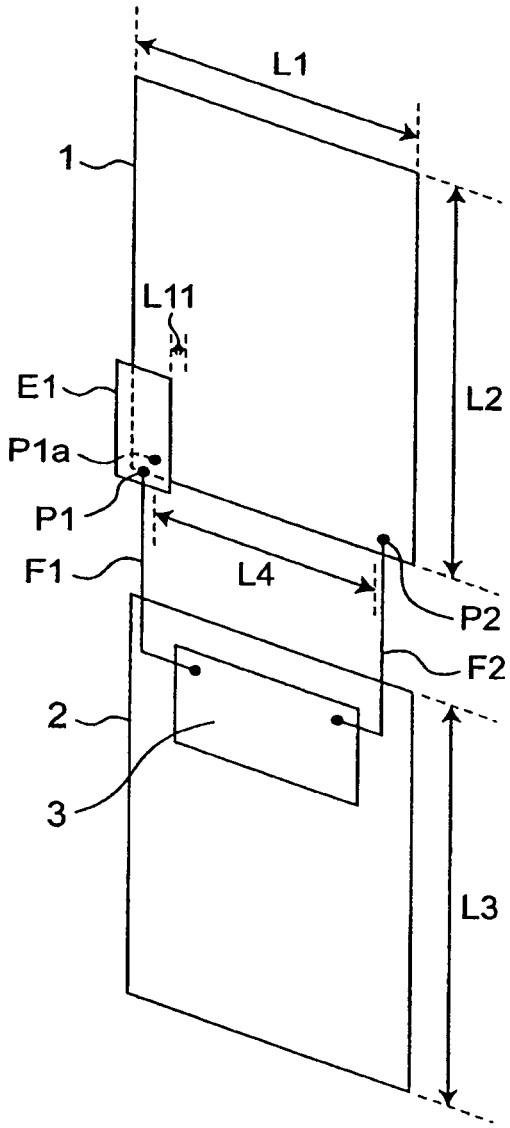
FIG. 6 is a perspective view showing a schematic configuration of an antenna apparatus according to a second preferred embodiment of the present invention.

FIG. 6 is a perspective view showing a schematic configuration of an antenna apparatus according to a second preferred embodiment of the present invention. Although in the antenna apparatus of the first preferred embodiment the radio signal is directly fed to the antenna element 1 at both of the feeding points P1 and P2, the antenna apparatus of the second preferred embodiment is characterized by that a radio signal is capacitively fed (fed through a capacitor) to a antenna element 1 at one of the feeding points P1 and P2 in FIG. 1, i.e., at a feeding point P1.

In FIG. 6, the antenna apparatus is provided with an electrode E1, which is made of a conductive plate and provided in parallel to an antenna element 1 at a position where the feeding point P1 is provided in FIG. 1. The electrode E1 is spaced from the antenna element 1 by a certain distance L11 through air or a certain dielectric material. Thus, in the antenna apparatus of the present preferred embodiment, a capacitor is formed by the electrode E1 and the antenna element 1, a feeding point P1 is provided on the electrode E1, and a radio signal is fed to the antenna element 1 through this capacitor. In the following description, the feeding point P1, the electrode E1, and the capacitor formed by the electrode E1 and the antenna element 1 are also referred to as a "capacitive feeding portion" of a first antenna portion. A point on the antenna element 1 that is closest to the feeding point P1 is regarded as a reference point P1*a* for the capacitive feeding, and a distance L4 between the reference point P1*a* and a feeding point P2 satisfies the expression (1), in a similar manner to that of the first preferred embodiment. The size of the electrode E1 is appropriately determined according to the frequency of radio signals transmitted and/or received by the antenna apparatus. Preferably, the size is determined such that the length in at least one direction of the electrode E1 (e.g., in the case of a rectangular electrode E1, the direction of a longitudinal side thereof) is $(1/4+n/2)\lambda$, where $\lambda$ denotes a wavelength of radio signals transmitted and/or received by the antenna apparatus, and n denotes an integer greater than or equal to 0.

In the antenna apparatus of the present preferred embodiment with the above described configuration, the feeding point P1 at which a radio signal is fed through a capacitor acts as a voltage feeding point, and the feeding point P2 at which a radio signal is fed directly acts as a current feeding point, and therefore, isolation between the first antenna portion and the second antenna portion improves as compared with the case of the first preferred embodiment. As such, in the antenna apparatus of the present preferred embodiment, it is possible to make the single antenna element 1 operate as two antenna portions such that the antenna element 1 is excited as the first antenna portion through the feeding point P1, and at the same time, the antenna element 1 is excited as the second antenna portion through the feeding point P2. Accordingly, while having a simple configuration, the antenna apparatus can simultaneously transmit and/or receive a plurality of radio signals with low correlation to each other. Note that in prior art circular polarization antennas, a single antenna element is simultaneously excited through two feeding points provided on the antenna element by two signals having a 90° phase difference relative to each other, on the other hand, the antenna apparatus of the present preferred embodiment does not have a constant phase difference between signals. Since the antenna apparatus of the present preferred embodiment can improve the isolation according to the distance L4, it is possible to simultaneously excite a plurality of feeding points by different signals, and thus achieve a MIMO operation, while having a simple configuration.

Figure 7:
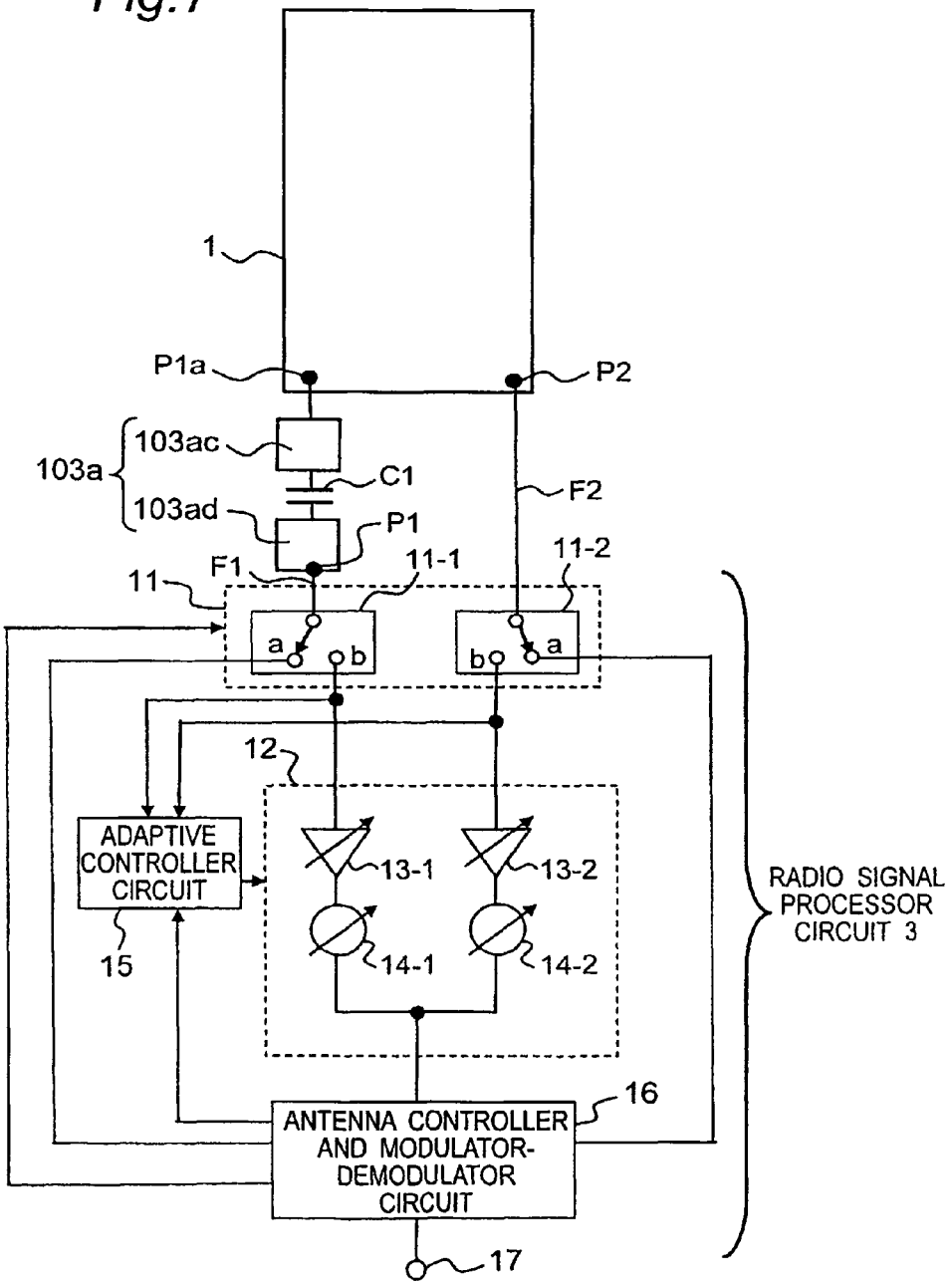
FIG. 7 is a block diagram showing a detailed configuration of a circuit of the antenna apparatus in FIG. 6.

FIG. 7 is a block diagram showing a detailed configuration of a circuit of the antenna apparatus in FIG. 6. A capacitive feeding portion of the first antenna portion is preferably provided within a left hinge portion 103*a*, as will be described in detail later with reference to FIGS. 8A, 8B, 8C and 8D. FIG. 7 shows that a space between conductive components 103*ac* and 103*ad* which configure the left hinge portion 103*a* (e.g., a space between the conductive components 103*ac* and 103*ad* spaced apart from each other by means of a dielectric) acts as a capacitor C1. The reference point P1*a* for the capacitive feeding of the antenna element 1 is connected to the left hinge portion 103*a*, and the feeding point P1 provided on the left hinge portion 103*a* is connected to a radio signal processor circuit 3 through the feed line F1.

Figure 8A:
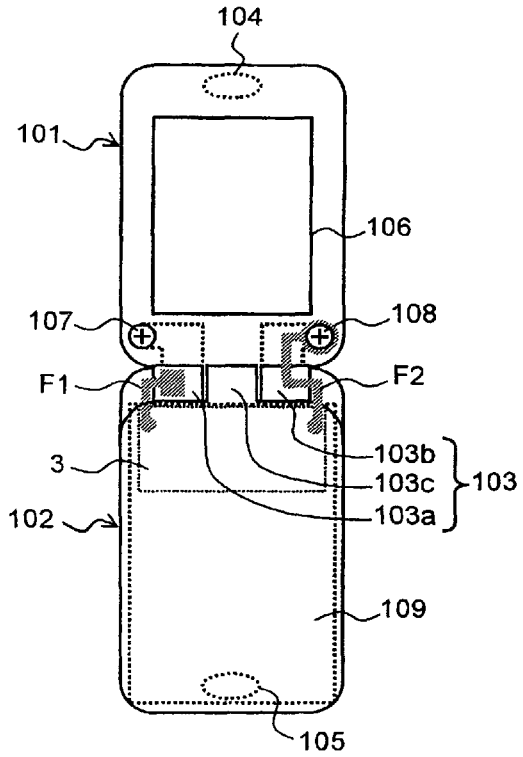
FIG. 8A is a front view of a mobile phone showing a first exemplary implementation of the antenna apparatus in FIG. 6.
Figure 8B:
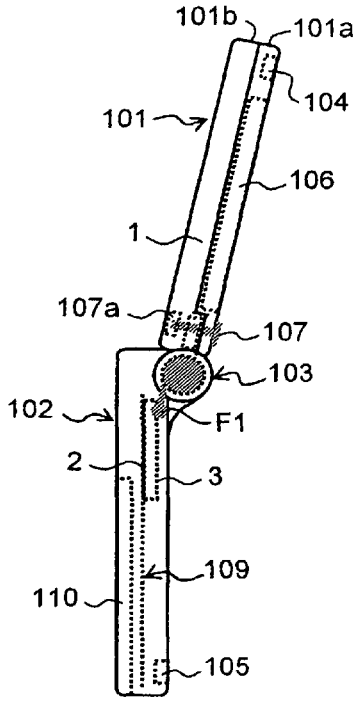
FIG. 8B is a side view of the mobile phone showing the first exemplary implementation of the antenna apparatus in FIG. 6.
Figure 8C:
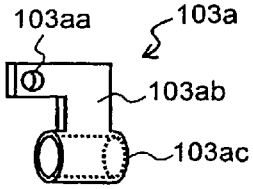
FIG. 8C is a perspective view showing a left hinge portion 103*a* of the mobile phone showing the first exemplary implementation of the antenna apparatus in FIG. 6.
Figure 8D:
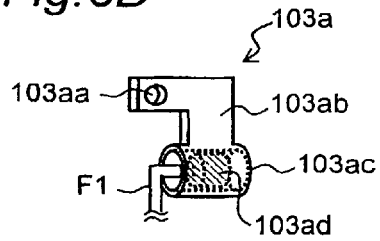
FIG. 8D is a perspective view showing a position at which an inner conductor 103*ad* is inserted into the left hinge portion 103*a* of the mobile phone showing the first exemplary implementation of the antenna apparatus in FIG. 6.

FIG. 8A is a front view of a mobile phone showing a first exemplary implementation of the antenna apparatus in FIG. 6, FIG. 8B is a side view thereof, FIG. 8C is a perspective view showing a left hinge portion 103*a* in FIG. 8A, and FIG. 8D is a perspective view showing a position at which an inner conductor 103*ad* is inserted into the left hinge portion 103*a* in FIG. 8C. In the mobile phone of the present exemplary implementation, the left hinge portion 103*a* is made of a conductive material such as aluminum or zinc, and has, as shown in FIG. 8C, an integral structure including a blade portion 103*ab* and a cylindrical portion 103*ac*. The blade portion 103*ab* has a screw hole 103*aa* for receiving a screw 107, by which the left hinge portion 103*a* is electrically and mechanically connected to a left bottom portion of an upper housing 101. As shown in FIG. 8D, a cylindrical inner conductor 103*ad* made of a conductive material is inserted into the cylindrical portion 103*ac* of the left hinge portion 103*a* in a rotatable manner. At least one of the inner side of the cylindrical portion 103*ac* and the outer side of the inner conductor 103*ad* is coated by a dielectric, and thus, when the inner conductor 103*ad* is inserted into the cylindrical portion 103*ac*, a capacitor C1 of FIG. 7 is formed between the inner side surface of the cylindrical portion 103*ac* and the outer side surface of the inner conductor 103*ad*. The inner conductor 103*ad* is connected to a radio signal processor circuit 3 through a feed line F1 made of a coaxial cable or the like. In the present exemplary implementation, in a similar manner to that of the exemplary implementation in FIGS. 4A and 4B, each of a first upper housing portion 101*a* and a second upper housing portion 101*b* is made of a conductor, and thus an upper housing 101 operates as the antenna element 1 in FIGS. 6 and 7. In the present exemplary implementation, a point at which the feed line F1 is connected to the inner conductor 103*ad* is regarded as a feeding point P1, and a point at which the left hinge portion 103*a* is connected to the upper housing 101 by the screw 107 is regarded as a reference point P1*a* for the capacitive feeding. In the mobile phone of the present exemplary implementation, a right hinge portion 103*b* also has an integral structure including a blade portion and a cylindrical portion, and the blade portion has a screw hole (not shown) for receiving a screw 108, by which the right hinge portion 103*a* is mechanically connected to the upper housing 101. A feed line F2 extends from the radio signal processor circuit 3 to the upper housing 101 through a pass-through hole (not shown) provided in the right hinge portion 103*b*, and is electrically connected to a right bottom portion of the first upper housing portion 101*a* by the screw 108. This connection point acts as a feeding point P2 of the antenna element 1.

Figure 9A:
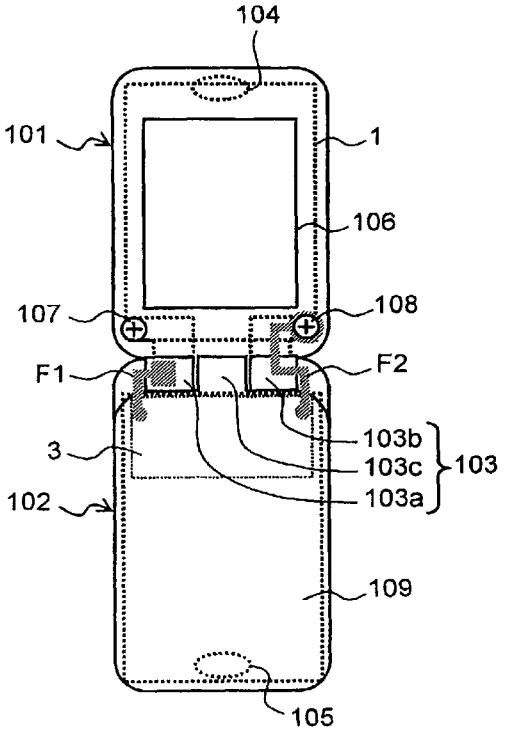
FIG. 9A is a front view of a mobile phone showing a second exemplary implementation of the antenna apparatus in FIG. 6.
Figure 9B:
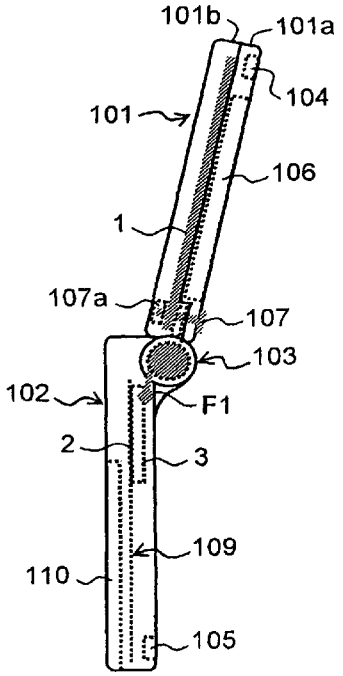
FIG. 9B is a side view of the mobile phone showing the second exemplary implementation of the antenna apparatus in FIG. 6.

FIG. 9A is a front view of a mobile phone showing a second exemplary implementation of the antenna apparatus in FIG. 6, and FIG. 9B is a side view thereof. The present exemplary implementation is characterized in that, in a similar manner to that of the exemplary implementation in FIGS. 5A and 5B, each of a first upper housing portion 101*a* and a second upper housing portion 101*b* is made of a dielectric, and an antenna element 1 made of a rectangular conductive plate is provided within an upper housing 101. In the present exemplary implementation, a left hinge portion 103*a* and a right hinge portion 103*b* themselves are configured in the same manner as in the exemplary implementation in FIGS. 8A, 8B, 8C and 8D. The left hinge portion 103*a* is mechanically connected to the upper housing 101 at a screw hole of a blade portion thereof, and is electrically connected to a left bottom portion of the antenna element 1. A point at which the left hinge portion 103*a* is connected to the antenna element 1 by a screw 107 is regarded as a reference point P1*a* for the capacitive feeding. On the other hand, the right hinge portion 103*b* is mechanically connected to the upper housing 101 at a screw hole of a blade portion thereof. A feed line F2 is electrically connected to a right bottom portion of the antenna element 1 by a screw 108, and this connection point acts as a feeding point P2 of the antenna element 1.

The exemplary implementations in FIGS. 8A, 8B, 8C, 8D, 9A and 9B describe the case in which the feed line F2 is made of a coaxial cable or the like, alternatively, as shown in FIG. 3, the right hinge portion 103*b* may be used as part of the feed line F2. In this case, the right hinge portion 103*b* is made of a conductive material, in a similar manner to that of the left hinge portion 103*a*, and a cylindrical inner conductor made of a conductive material is inserted into a cylindrical portion of the right hinge portion 103*b* in a rotatable manner. An electrical connection is established between the inner side surface of the cylindrical portion and the outer side surface of the inner conductor without providing dielectric coating to any of the inner side of the cylindrical portion and the outer side of the inner conductor, and furthermore, in a similar manner to that of the inner conductor 103*ad* of the left hinge portion 103*a*, an inner conductor of the right hinge portion 103*b* is connected to the radio signal processor circuit 3 through a coaxial cable or the like. In this configuration, a point at which the right hinge portion 103*b* is connected to the upper housing 101 or the antenna element 1 by the screw 108 acts as a feeding point P2.

As described above, according to the antenna apparatus of the present preferred embodiment, it is possible to make the single antenna element 1 operate as two antenna portions, and accordingly, while having a simple configuration, the antenna apparatus can simultaneously transmit and/or receive a plurality of radio signals with low correlation to each other.

Third Preferred Embodiment

Figure 10:
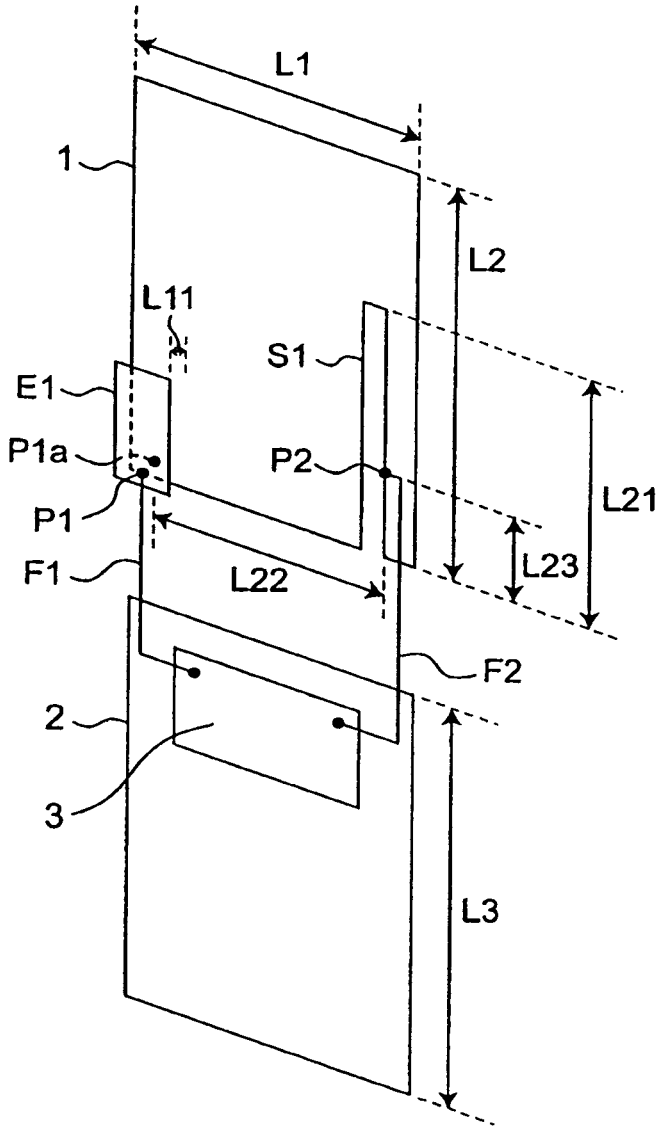
FIG. 10 is a perspective view showing a schematic configuration of an antenna apparatus according to a third preferred embodiment of the present invention.
Figure 11:
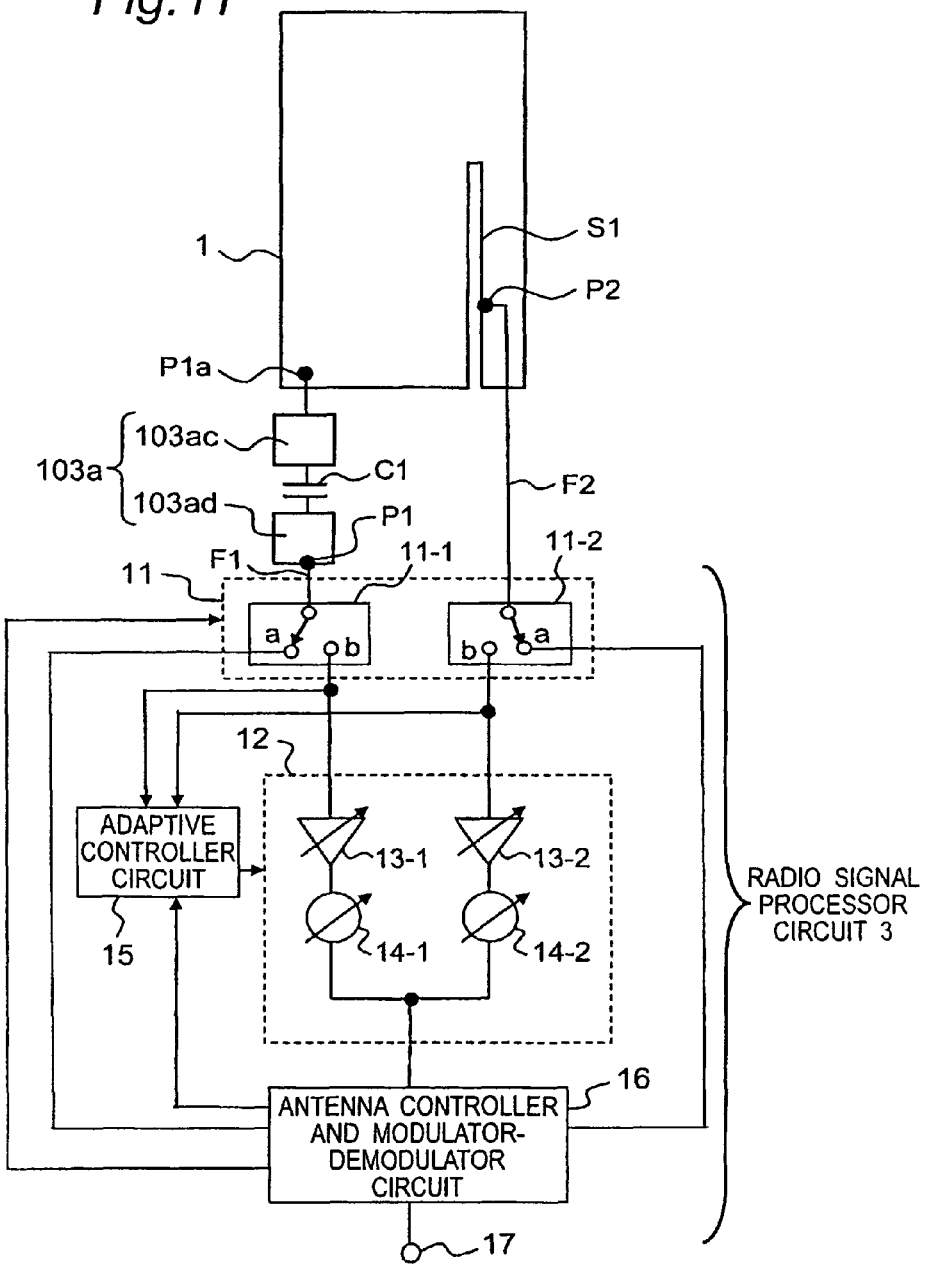
FIG. 11 is a block diagram showing a detailed configuration of a circuit of the antenna apparatus in FIG. 10.

FIG. 10 is a perspective view showing a schematic configuration of an antenna apparatus according to a third preferred embodiment of the present invention, and FIG. 11 is a block diagram showing a detailed configuration of a circuit of the antenna apparatus in FIG. 10. Although in the antenna apparatus of the second preferred embodiment the antenna element 1 operates as an electric current antenna (i.e., an antenna in which the antenna element 1 acts as an electric current source) in each of both cases in which the radio signal is capacitively fed to the antenna element 1 through the feeding point P1 and in which the radio signal is fed directly to the antenna element 1 through the feeding point P2, the antenna apparatus of the third preferred embodiment is characterized in that the antenna apparatus further has a slit S1, and when a radio signal is fed to the slit S1 through a feeding point P2, the slit S1 is made to operate as a magnetic current antenna (i.e., an antenna in which the slit S1 acts as a magnetic current source), or a slit antenna.

Referring to FIG. 10, the antenna apparatus of the present preferred embodiment is provided with, on an antenna element 1, a capacitive feeding portion configured in the same manner as in FIG. 6, and with a slit S1 having a certain width and a length L21 and having an open end at one end thereof. The slit S1 has, as its open end, an opening at a side of the antenna element 1 opposing to a ground conductor 2, and the opening of the slit S1 is located apart from a reference point P1*a* for the capacitive feeding of a first antenna portion by a distance L22. In addition, a feeding point P2 is provided along the slit S1 at a position apart from the opening of the slit S1 by a distance L23, and the feeding point P2 is connected to a radio signal processor circuit 3 through a feed line F2 made of a coaxial cable or the like, in a similar manner to those of the first and second preferred embodiments.

A distance L22+L23 between the feeding points P1 and P2 satisfies the following relation of expression (2):

$$L22+L23=(1/4+n/2)\lambda \quad (2),$$

where λ denotes a wavelength of radio signals transmitted and/or received by the antenna apparatus, and n denotes an integer greater than or equal to 0.

Although FIG. 10 shows that the feeding point P2 is positioned apart from the opening of the slit S1 by the distance L23, the present invention is not limited so, and the feeding point P2 can be provided at a desired position along the slit S1, as long as the position satisfies the expression (2) (i.e., 0≤L23<L21).

According to the antenna apparatus of the present preferred embodiment, the antenna element 1 is made to operate as an electric current antenna (first antenna portion) by feeding at the feeding point P1 the antenna element 1 made of a conductive plate with voltage through a capacitor, on the other hand, the slit S1 is made to operate as a magnetic current antenna (second antenna portion) by directly feeding the slit S1 with current at the feeding point P2. Accordingly, in the antenna apparatus of the present preferred embodiment, the distance between the feeding points P1 and P2 is configured according to the expression (2), and additionally, polarization directions each formed when the antenna element 1 is excited through the feeding point P1 and when the antenna element 1 is excited through the feeding point P2 are different from each other, by the differences of the planar antenna and slit antenna, the capacitive feeding and direct feeding, the voltage feeding and current feeding, and the electric current antenna and magnetic current antenna. Therefore, in the present preferred embodiment, isolation between the first antenna portion and the second antenna portion is improved as compared with the case of the first and second preferred embodiments, and −10 dB or better isolation can be achieved. As such, in the antenna apparatus of the present preferred embodiment, it is possible to make the single antenna element 1 operate as two antenna portions such that the antenna element 1 is excited as the first antenna portion through the feeding point P1, and at the same time, the slit S1 is excited as the second antenna portion through the feeding point P2. Accordingly, while having a simple configuration, the antenna apparatus can simultaneously transmit and/or receive a plurality of radio signals with low correlation to each other.

Figure 12A:
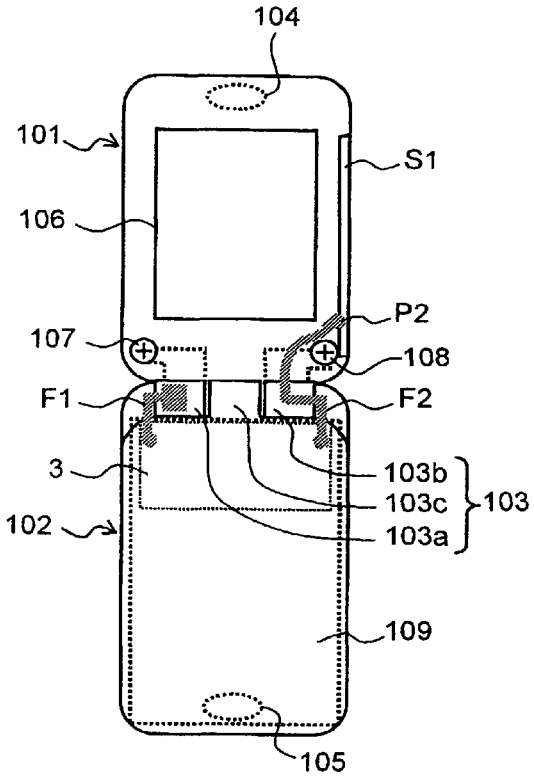
FIG. 12A is a front view of a mobile phone showing a first exemplary implementation of the antenna apparatus in FIG. 10.
Figure 12B:
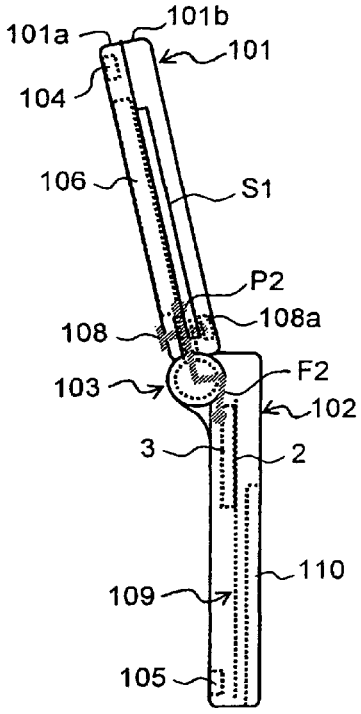
FIG. 12B is a side view of the mobile phone showing the first exemplary implementation of the antenna apparatus in FIG. 10.

FIG. 12A is a front view of a mobile phone showing a first exemplary implementation of the antenna apparatus in FIG. 10, and FIG. 12B is a side view thereof. In the present exemplary implementation, each of a first upper housing portion 101*a* and a second upper housing portion 101*b* is made of a conductor in a similar manner to those of the exemplary implementations in FIGS. 4A, 4B, 8A, 8B, 8C and 8D, and a slit S1 is formed in a right side surface of an upper housing 101 and between the first upper housing portion 101*a* and the second upper housing portion 101*b*. For the purpose of configuring a lower end of the slit S1 (i.e., an end of the slit S1 on the side close to a hinge portion 103) as an open end, a portion of the hinge portion 103 opposing the lower end of the slit S1 is preferably made as empty space or made of a dielectric material. A feeding point P2 is provided at a position upward from the lower end of the slit S1 by a certain distance, and in a similar manner to those of the exemplary implementations in FIGS. 8A, 8B, 8C and 8D, the feeding point P2 extends to a lower housing 102 through a feed line F2, and then, is connected to a radio signal processor circuit 3. Thus, the upper housing 101 operates as an antenna element 1 having the slit S1 in FIGS. 10 and 11. The space inside the slit S1 is preferably filled by a dielectric material, for mechanical reinforcement.

Figure 13A:
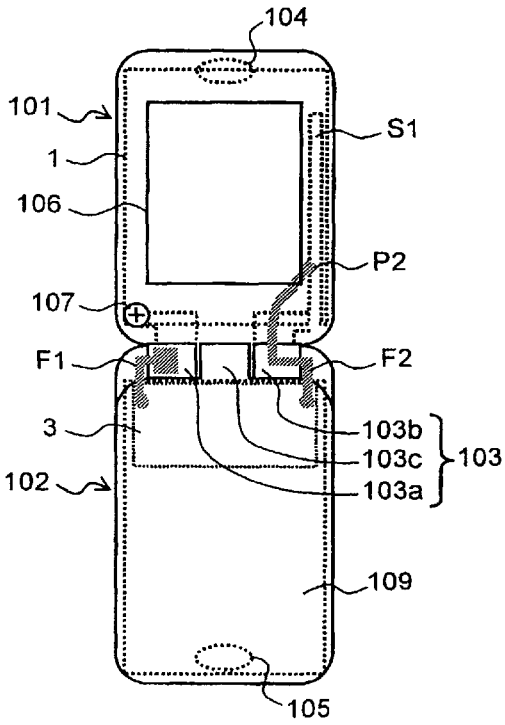
FIG. 13A is a front view of a mobile phone showing a second exemplary implementation of the antenna apparatus in FIG. 10.
Figure 13B:
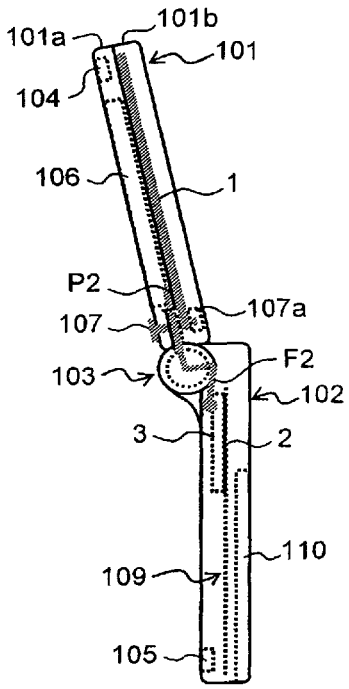
FIG. 13B is a side view of the mobile phone showing the second exemplary implementation of the antenna apparatus in FIG. 10.

FIG. 13A is a front view of a mobile phone showing a second exemplary implementation of the antenna apparatus in FIG. 10, and FIG. 13B is a side view thereof. The present exemplary implementation is characterized in that each of a first upper housing portion 101*a* and a second upper housing portion 101*b* is made of a dielectric, an antenna element 1 made of a rectangular conductive plate is provided within an upper housing 101, in a similar manner to those of the exemplary implementations in FIGS. 5A, 5B, 9A and 9B, and furthermore, a slit S1 is formed in the antenna element 1. A lower end of the slit S1 is configured as an open end, and a feeding point P2 is provided at a position upward from the lower end by a certain distance. As with the exemplary implementation in FIGS. 8A, 8B, 8C and 8D, the feeding point P2 extends to a lower housing 102 through a feed line F2, and then, is connected to a radio signal processor circuit 3.

As described above, according to the antenna apparatus of the present preferred embodiment, it is possible to make the single antenna element 1 operate as two antenna portions, and accordingly, while having a simple configuration, the antenna apparatus can simultaneously transmit and/or receive a plurality of radio signals with low correlation to each other.

Fourth Preferred Embodiment

Figure 14:
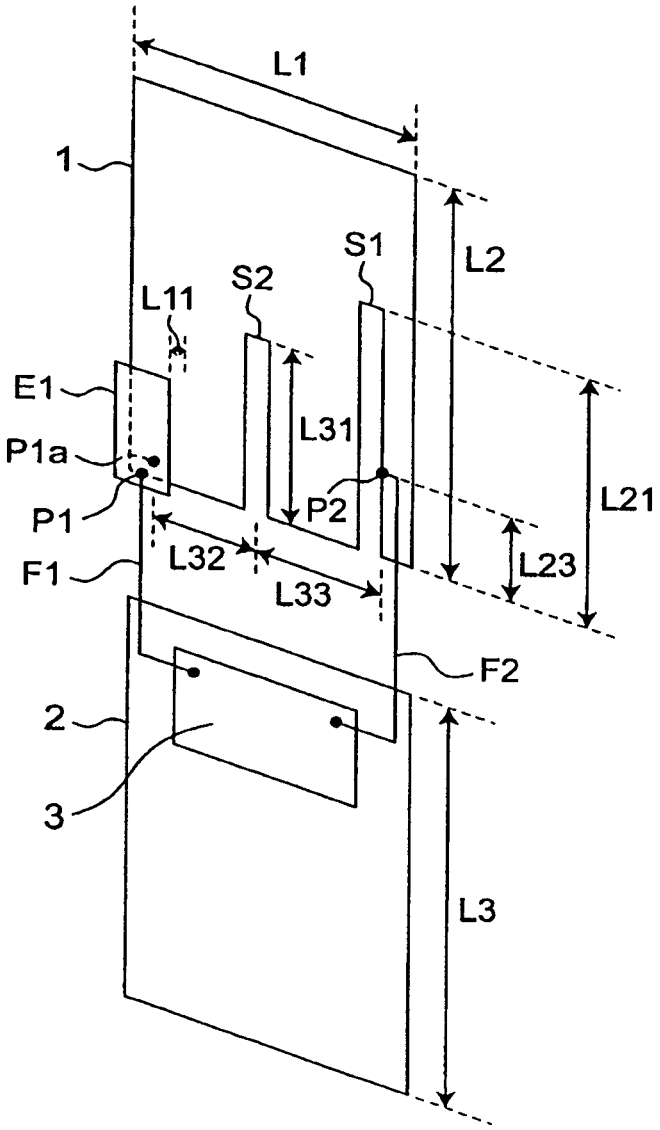
FIG. 14 is a perspective view showing a schematic configuration of an antenna apparatus according to a fourth preferred embodiment of the present invention.
Figure 15:
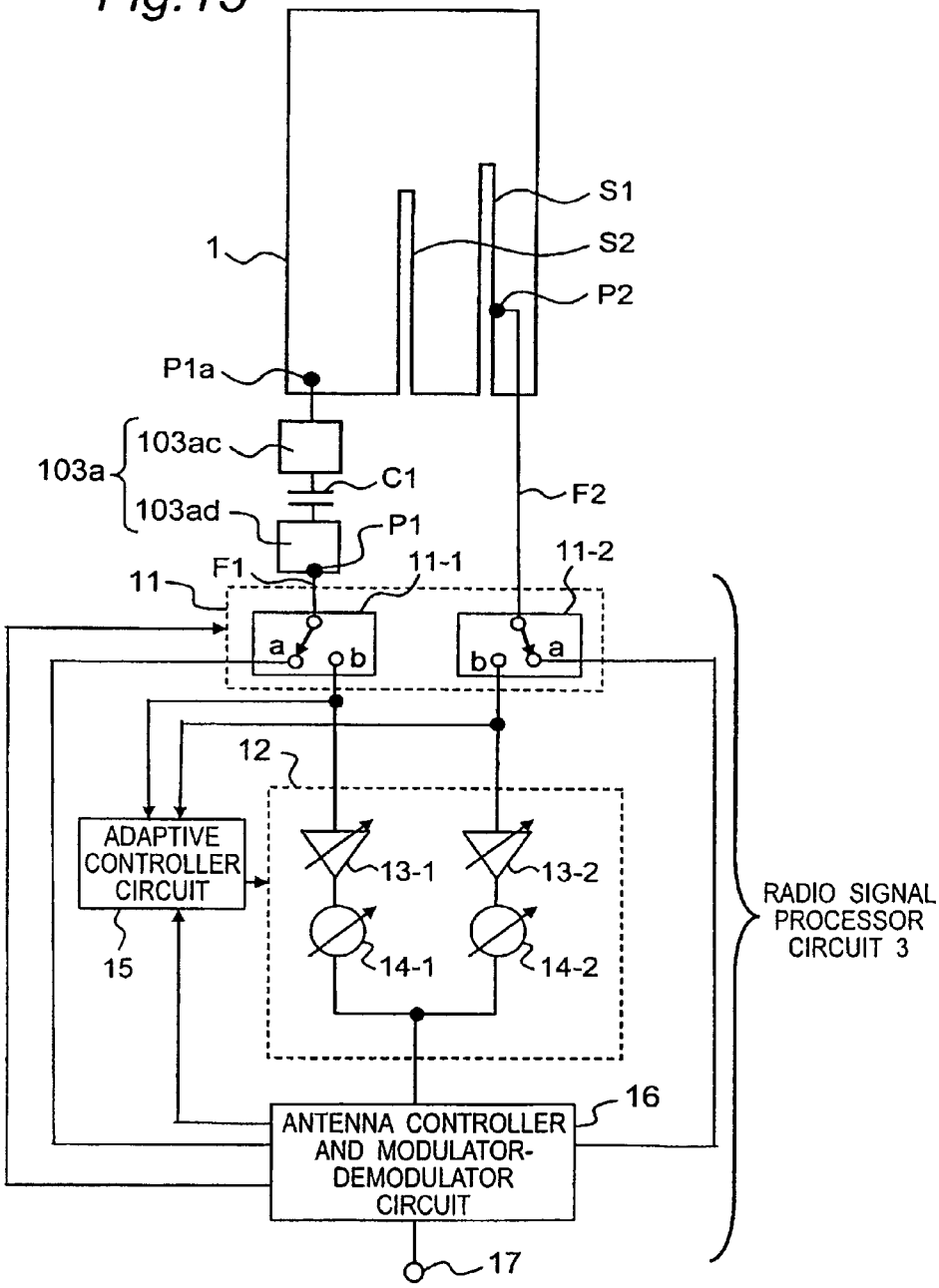
FIG. 15 is a block diagram showing a detailed configuration of a circuit of the antenna apparatus in FIG. 14.

FIG. 14 is a perspective view showing a schematic configuration of an antenna apparatus according to a fourth preferred embodiment of the present invention and FIG. 15 is a block diagram showing a detailed configuration of a circuit of the antenna apparatus in FIG. 14. The antenna apparatus of the present preferred embodiment is characterized by the configuration of the antenna apparatus of the third preferred embodiment, and additionally, by having a slit S2 for adjusting electromagnetic coupling, between a first antenna portion and a second antenna portion, so that a certain amount of isolation between the first antenna portion and the second antenna portion is ensured.

Referring to FIG. 14, the antenna apparatus of the present preferred embodiment is provided with, on an antenna element 1, the configuration of the antenna apparatus in FIG. 10, and additionally, a slit S2 having a certain width and a length L31 and having an open end at one end thereof. The slit S2 has, as its open end, an opening at a side of the antenna element 1 opposing a ground conductor 2, and between a reference point P1*a* for the capacitive feeding of a first antenna portion and an opening of a slit S1 of a second antenna portion. The opening of the slit S2 is located apart from the reference point P1*a* for the capacitive feeding by a distance L32, and apart from the opening of the slit S1 by a distance L33.

A distance L32+2×L31+L33+L23 between feeding points P1 and P2 satisfies the following relation of expression (3):

$$L32+2\times L31+L33+L23=(1/4+n/2)\lambda \quad (3),$$

where λ denotes a wavelength of radio signals transmitted and/or received by the antenna apparatus, and n denotes an integer greater than or equal to 0.

Although FIG. 14 shows that the feeding point P2 is positioned apart from the opening of the slit S1 by the distance L23, the present invention is not limited so, and the feeding point P2 can be provided at a desired position along the slit S1, as long as the position satisfies the expression (3) (i.e., 0≤L23<L21).

According to the antenna apparatus of the present preferred embodiment, isolation between the first antenna portion and the second antenna portion is further improved over that of the antenna apparatus of the third preferred embodiment, by virtue of the slit S2 for adjusting electromagnetic coupling between the first antenna portion and the second antenna portion. As such, in the antenna apparatus of the present preferred embodiment, it is possible to make the single antenna element 1 operate as two antenna portions such that the antenna element 1 is excited as the first antenna portion through the feeding point P1, and at the same time, the slit S1 is excited as the second antenna portion through the feeding point P2. Accordingly, while having a simple configuration, the antenna apparatus can simultaneously transmit and/or receive a plurality of radio signals with low correlation to each other.

Figure 16A:
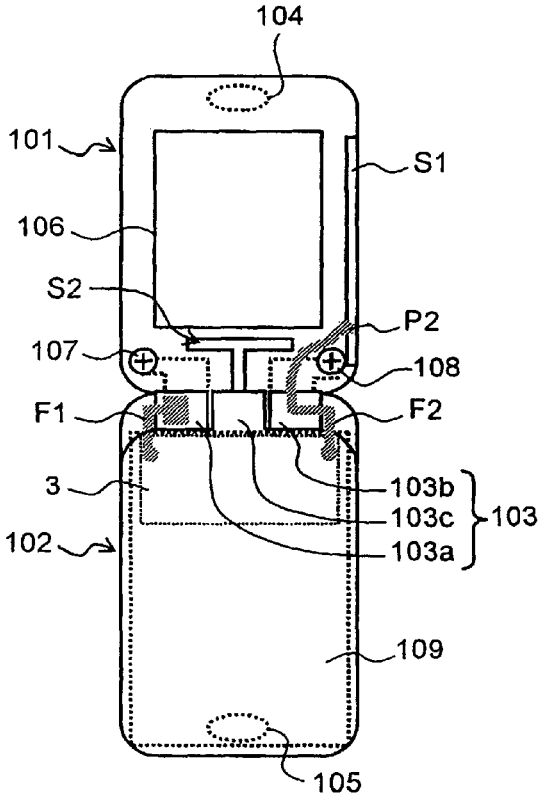
FIG. 16A is a front view of a mobile phone showing a first exemplary implementation of the antenna apparatus in FIG. 14.
Figure 16B:
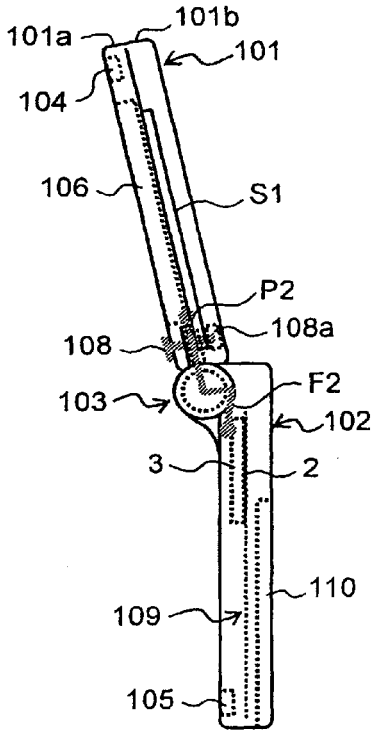
FIG. 16B is a side view of the mobile phone showing the first exemplary implementation of the antenna apparatus in FIG. 14.
Figure 16C:
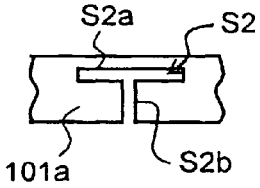
FIG. 16C is a top view showing a detailed configuration of a slit S2 of the mobile phone showing the first exemplary implementation of the antenna apparatus in FIG. 14.

FIG. 16A is a front view of a mobile phone showing a first exemplary implementation of the antenna apparatus in FIG. 14, FIG. 16B is a side view thereof, and FIG. 16C is a top view showing a detailed configuration of a slit S2 in FIG. 16A. The present exemplary implementation is provided with the configuration of the exemplary implementation in FIGS. 12A and 12B, and additionally, a slit S2 within a first upper housing portion 101*a* below a display 106. In the present exemplary implementation, for ensuring the length L31 of the slit S2, the slit S2 is configured as a T-shaped slit as shown in FIG. 16C, which consists of a horizontal slit S2*a* and a vertical slit S2*b*, and in which the sum of the length of the slit S2*a* and the length of the slit S2*b* is the length L31. For the purpose of configuring a lower end of the slit S2 as an open end, it is preferable that a central hinge portion 103*c* opposing a lower end of the vertical slit S2*b* is preferably made of a dielectric material. Thus, an upper housing 101 operates as the antenna element 1 having the slit S2 in FIGS. 14 and 15. The space inside the slit 2 is preferably filled by a dielectric material, for mechanical reinforcement. The slit S2 is not limited to be configured in T-shape, and an arbitrary shape having the length L31 can be employed.

Figure 17A:
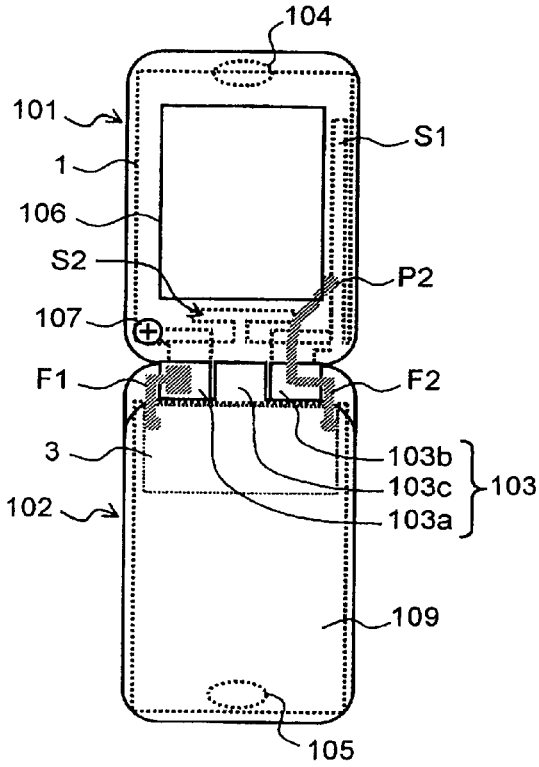
FIG. 17A is a front view of a mobile phone showing a second exemplary implementation of the antenna apparatus in FIG. 14.
Figure 17B:
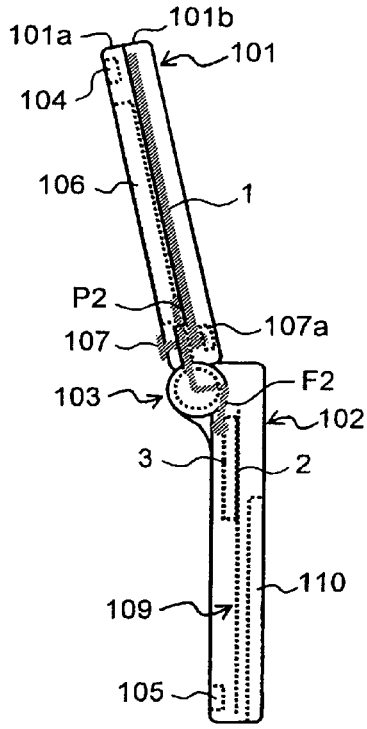
FIG. 17B is a side view of the mobile phone showing the second exemplary implementation of the antenna apparatus in FIG. 14.
Figure 17C:
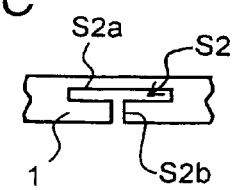
FIG. 17C is a top view showing a detailed configuration of a slit S2 of the mobile phone showing the second exemplary implementation of the antenna apparatus in FIG. 14.

FIG. 17A is a front view of a mobile phone showing a second exemplary implementation of the antenna apparatus in FIG. 14, FIG. 17B is a side view thereof, and FIG. 17C is a top view showing a detailed configuration of a slit S2 in FIG. 17A. The present exemplary implementation is provided with the configuration of the exemplary implementation in FIGS. 13A and 13B, and additionally, a slit S2 on an antenna element 1. In the present exemplary implementation, in a similar manner to that of the exemplary implementation in FIGS. 16A, 16B and 16C, the slit S2 is configured as a T-shaped slit as shown in FIG. 17C, which consists of a horizontal slit S2*a* and a vertical slit 32*b*, and in which the sum of the length of the slit S2*a* and the length of the slit S2*b* is the length L31. A lower end of the slit S2 (i.e., a lower end of the vertical slit S2*b*) is configured as an open end. The slit S2 is not limited to be configured in T-shape, and an arbitrary shape having the length L31 can be employed.

Figure 18:
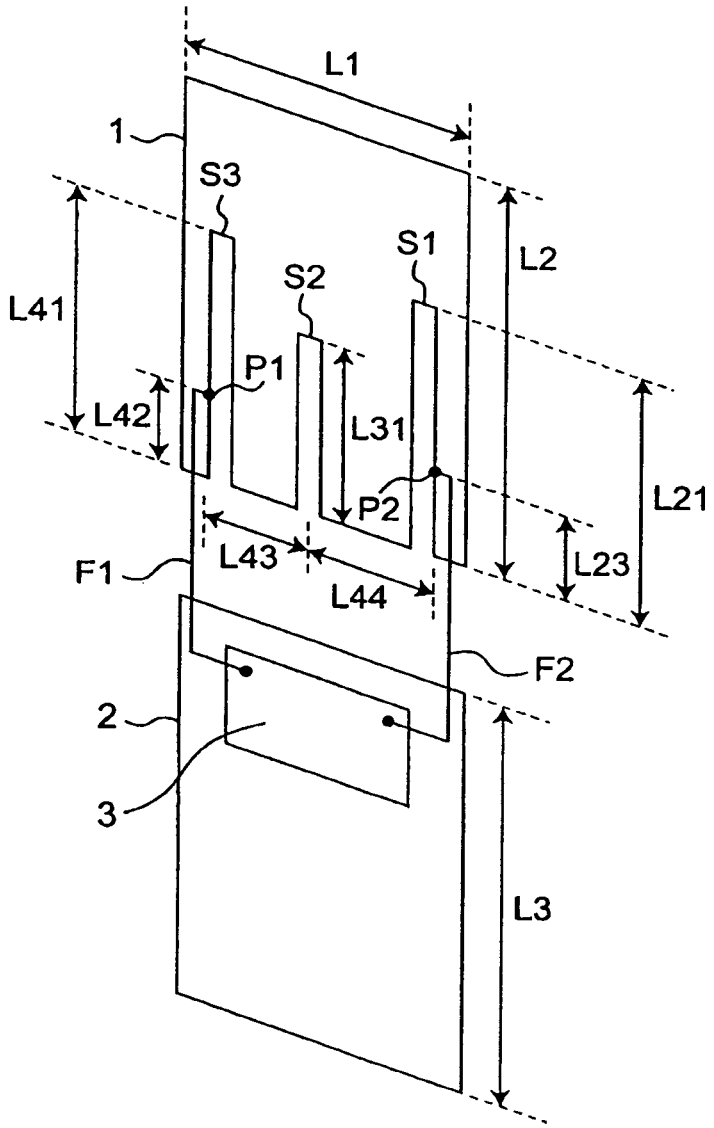
FIG. 18 is a perspective view showing a schematic configuration of an antenna apparatus according to a first modified preferred embodiment of the fourth preferred embodiment of the present invention.

FIG. 18 is a perspective view showing a schematic configuration of an antenna apparatus according to a first modified preferred embodiment of the fourth embodiment of the present invention. Although in the antenna apparatus in FIG. 14 the first antenna portion is made to operate as an electric current antenna and the second antenna portion is made to operate as a magnetic current antenna, the present modified preferred embodiment is characterized in that the antenna apparatus has a slit S3 instead of the electrode E1 in FIG. 14, and a first antenna portion is also made to operate as a magnetic current antenna (or a slit antenna).

Referring to FIG. 18, the antenna apparatus of the present modified preferred embodiment is provided with, on an antenna element 1, a slit S3 having a certain width and a length L41 and having an open end at one end thereof, instead of the capacitive feeding portion including the electrode E1 of the first antenna portion in FIG. 14. The slit S3 has, as its open end, an opening at a side of the antenna element 1 opposing a ground conductor 2, and the opening of the slit S3 is located apart from an opening of a slit S2 by a distance L43, and the opening of the slit S2 is located apart from an opening of a slit S1 by a distance L44. In addition, a feeding point P1 is provided along the slit S3 at a position apart from the opening of the slit S3 by a distance L42, and the feeding point P1 is connected to a radio signal processor circuit 3 through a feed line F1 made of a coaxial cable or the like, in a similar manner to that of a feeding point P2 of the slit S1.

A distance L42+L43+2×L31+L44+L23 between the feeding points P1 and P2 satisfies the following relation of expression (4):

$$L42+L43+2\times L31+L44+L23=(1/4+n/2)\lambda \quad (4),$$

where λ denotes a wavelength of radio signals transmitted and/or received by the antenna apparatus, and n denotes an integer greater than or equal to 0.

Although FIG. 18 shows that the feeding point P1 is positioned apart from the opening of the slit S3 by the distance L42 and the feeding point P2 is positioned apart from the opening of the slit S1 by the distance L23, the present invention is not limited so, and the feeding point P1 can be provided at a desired position along the slit S3, as long as the position satisfies the expression (4) (i.e., 0≤L42<L41), and similarly, the feeding point P2 can be provided at a desired position along the slit S1 (i.e., 0≤L23<L21).

According to the antenna apparatus of the present modified preferred embodiment, the distance between the feeding points P1 and P2 is configured according to the expression (4), and additionally, the slit S2 is provided for adjusting electromagnetic coupling between the first antenna portion and the second antenna portion, thus even in the case that both of the first antenna portion and the second antenna portion are excited as magnetic current antennas, sufficient isolation between the first antenna portion and the second antenna portion (e.g., −10 dB or better isolation) can be achieved. As such, in the antenna apparatus of the present preferred embodiment, it is possible to make the single antenna element 1 operate as two antenna portions such that the slit S3 is excited as the first antenna portion through the feeding point P1, and at the same time, the slit S1 is excited as the second antenna portion through the feeding point P2. Accordingly, while having a simple configuration, the antenna apparatus can simultaneously transmit and/or receive a plurality of radio signals with low correlation to each other.

Figure 19:
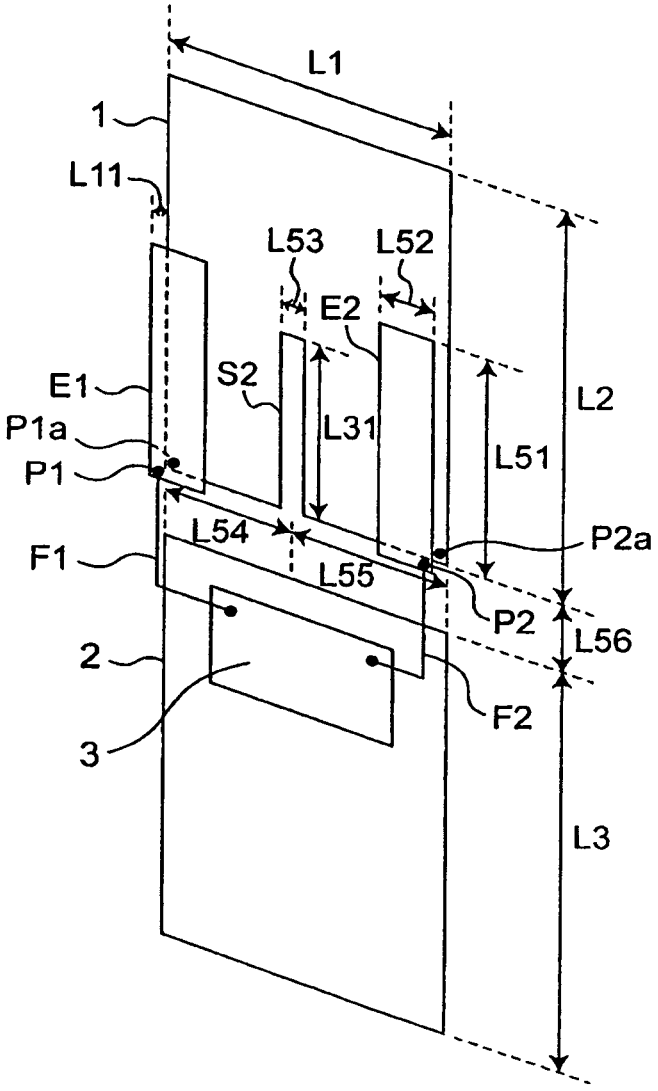
FIG. 19 is a perspective view showing a schematic configuration of an antenna apparatus according to a second modified preferred embodiment of the fourth preferred embodiment of the present invention.

FIG. 19 is a perspective view showing a schematic configuration of an antenna apparatus according to a second modified preferred embodiment of the fourth preferred embodiment of the present invention. Although in the antenna apparatus in FIG. 14 the first antenna portion is made to operate as an electric current antenna and the second antenna portion is made to operate as a magnetic current antenna, the present modified preferred embodiment is characterized in that the antenna apparatus is provided with an electrode E2 instead of the slit S1 in FIG. 14, and a second antenna portion is also made to operate as an electric current antenna.

Referring to FIG. 19, the antenna apparatus of the present modified preferred embodiment is provided with, on an antenna element 1, an electrode E2 made of a conductive plate and provided in parallel to the antenna element 1, instead of the slit S1 in FIG. 14. The electrode E2 is spaced from the antenna element 1 by a certain distance through air or a certain dielectric material (in the antenna apparatus in FIG. 19, the electrode E2 is spaced by the same distance L11 as the electrode E1). Thus, in the antenna apparatus of the present modified preferred embodiment, a capacitor is formed by the electrode E2 and the antenna element 1, a feeding point P2 is provided on the electrode E2, and a radio signal is fed to the antenna element 1 through this capacitor. As such, the feeding point P2, the electrode E2, and the capacitor formed by the electrode E2 and the antenna element 1 configure a capacitive feeding portion for a second antenna portion. A point on the antenna element 1 that is closest to the feeding point P2 is regarded as a reference point P2*a* for the capacitive feeding. The size of the electrode E2 is appropriately determined according to the frequency of radio signals transmitted and/or received by the antenna apparatus, in a similar manner to that of the electrode E1. Preferably, the size is determined such that the length in at least one direction of the electrode E2 (e.g., in the case of a rectangular electrode E2, the direction of a longitudinal side thereof) is $(1/4+n/2)*\lambda$, where $\lambda$ denotes a wavelength of radio signals transmitted and/or received by the antenna apparatus, and n denotes an integer greater than or equal to 0. In the following description, each of the electrodes E1 and E2 is made of a rectangular conductive plate with a horizontal length L52×a vertical length L51, the electrode E1 is located such that the left and bottom sides thereof are close to the left and bottom sides of the rectangular antenna element 1, and the electrode E2 is located such that the right and bottom sides thereof are close to the right and bottom sides of the antenna element 1. A feeding point P1 is provided at a left bottom end of the electrode E1, and the feeding point P2 is provided at a right bottom end of the electrode E2. Accordingly, a reference point P1*a* for the capacitive feeding is located at a left bottom end of the antenna element 1, and the reference point P2*a* is located at a right bottom end of the antenna element 1. A slit S2 has a length L31 and a width L53, and is provided in parallel to left and right sides of the antenna element 1. An opening at a lower end of the slit S2 is located apart from the reference point P1*a* for the capacitive feeding toward the right by a distance L54, and apart from the reference point P2*a* toward the left by a distance L55. The antenna element 1 and a ground conductor 2 are in the same plane, and are spaced from each other by a distance L56.

A distance L54+2×L31+L55 between the feeding points P1 and P2 satisfies the following relation of expression (5):

$$L54+2\times L31+L55=(1/4+n/2)\lambda \quad (5),$$

where $\lambda$ denotes a wavelength of radio signals transmitted and/or received by the antenna apparatus, and n denotes an integer greater than or equal to 0.

According to the antenna apparatus of the present modified preferred embodiment, the distance between the feeding points P1 and P2 is configured according to the expression (5), and additionally, the slit S2 is formed for adjusting electromagnetic coupling between the first antenna portion and the second antenna portion, thus even in the case that both of the first antenna portion and the second antenna portion are excited as electric current antennas, sufficient isolation between the first antenna portion and the second antenna portion (e.g., −10 dB or better isolation) can be achieved. As such, in the antenna apparatus of the present preferred embodiment, it is possible to make the single antenna element 1 operate as two antenna portions such that the antenna element 1 is excited as the first antenna portion through the feeding point P1, and at the same time, the antenna element 1 is excited as the second antenna portion through the feeding point P2. Accordingly, while having a simple configuration, the antenna apparatus can simultaneously transmit and/or receive a plurality of radio signals with low correlation to each other.

Figure 20:
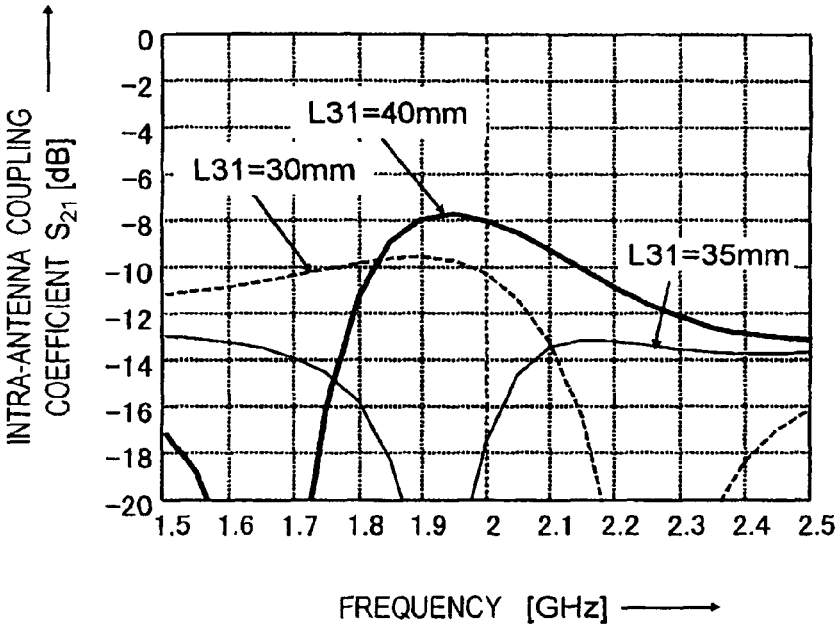
FIG. 20 is a graph showing an intra-antenna coupling coefficient $S_{21}$ versus frequency, in the antenna apparatus in FIG. 19.
Figure 21:
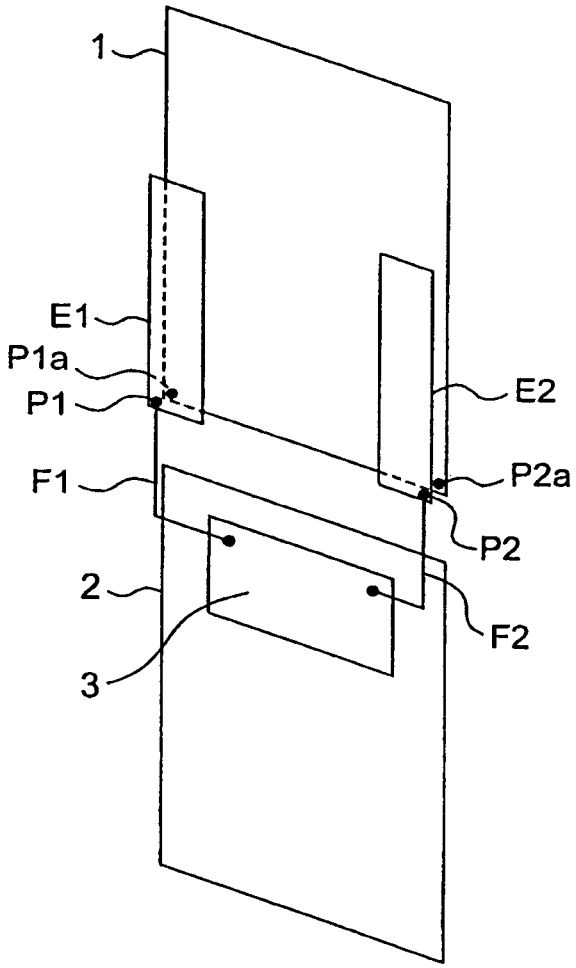
FIG. 21 is a perspective view showing a schematic configuration of an antenna apparatus without a slit S2, which is a comparative example of the antenna apparatus in FIG. 19.
Figure 22:
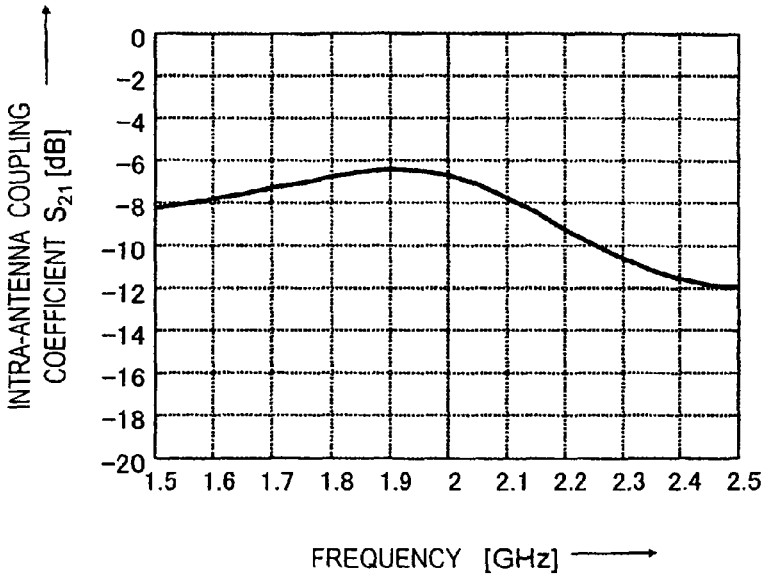
FIG. 22 is a graph showing an intra-antenna coupling coefficient $S_{21}$ versus frequency, in the antenna apparatus in FIG. 21.

Referring to FIGS. 20 to 22, effects of forming the slit S2 in the antenna apparatus of the present preferred embodiment will be described below. In a simulation conducted by the inventors of the present invention, it is examined how isolation between the first antenna portion and the second antenna portion varies while changing the length L31 of the slit S2 in the antenna apparatus in FIG. 19. In order to identify the isolation between the first antenna portion and the second antenna portion, a parameter $S_{21}$ of a transfer coefficient (hereinafter, referred to as the intra-antenna coupling coefficient $S_{21}$) is used which is defined from a first port of the radio signal processor circuit 3 connected to the feeding point P1 through the feed line F1 of 50Ω, to a second port of the radio signal processor circuit 3 connected to the feeding point P2 through the feed line F2 of 50Ω.

FIG. 20 is a graph showing the intra-antenna coupling coefficient $S_{21}$ versus frequency, in the antenna apparatus in FIG. 19. In the simulation of FIG. 20, the antenna element 1 is configured with the following dimensions (in millimeter).

TABLE 1

| |
|---|
| L1 = 45 |
| L2 = L3 = 90 |
| L11 = 1 |
| L31 = 30, 35, 40 |
| L51 = 43 |
| L52 = 10 |
| L53 = 1 |
| L54 = L55 = 22.5 |
| L56 = 5 |

According to FIG. 20, it can be seen that isolation characteristics is improved depending on the length L31 of the slit S2. Comparing to the cases in which the length L31 of the slit S2 is 30 mm and 40 mm, it can be concluded that when the length L31 of the slit S2 is 35 mm, an optimum value of isolation characteristics is obtained.

On the other hand, for comparison, simulation results for the case in which the slit S2 is omitted are shown. FIG. 21 is a perspective view showing a schematic configuration of an antenna apparatus without a slit S2, which is a comparative example of the antenna apparatus in FIG. 19, and FIG. 22 is a graph showing the intra-antenna coupling coefficient $S_{21}$ versus frequency, in the antenna apparatus in FIG. 21. The structure of the antenna apparatus in FIG. 21 is the same as that of the antenna apparatus used for the simulation in FIG. 20, except that a slit 32 is omitted. According to FIG. 22, when a slit S2 is omitted, isolation between the first antenna portion and the second antenna portion is insufficient.

As described above, according to the antenna apparatus of the present preferred embodiment, it is possible to make the single antenna element 1 operate as two antenna portions, and accordingly, while having a simple configuration, the antenna apparatus can simultaneously transmit and/or receive a plurality of radio signals with low correlation to each other.

Fifth Preferred Embodiment

Figure 23:
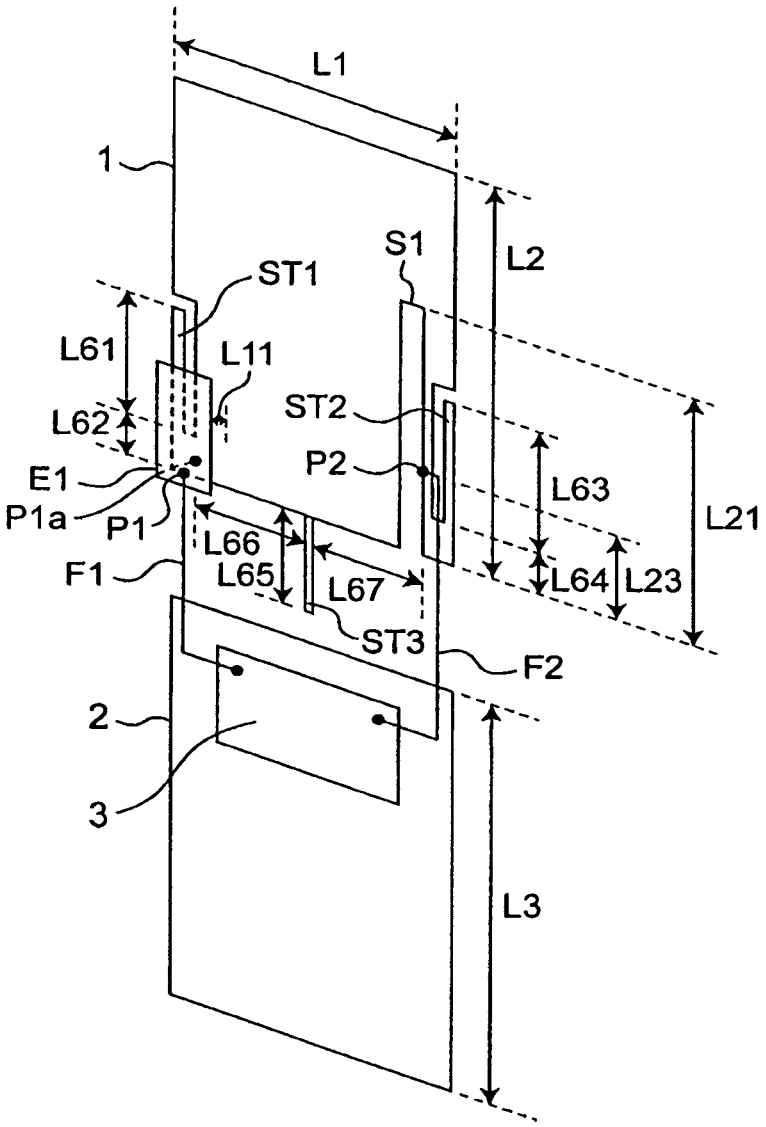
FIG. 23 is a perspective view showing a schematic configuration of an antenna apparatus according to a fifth preferred embodiment of the present invention.

FIG. 23 is a perspective view showing a schematic configuration of an antenna apparatus according to a fifth preferred embodiment of the present invention. The configuration for improving the isolation between a first antenna portion and a second antenna portion is not limited to the one provided with a slit S2, as in the fourth preferred embodiment, and alternatively, stub conductors ST1, ST2 and ST3 such as those shown in FIG. 23 may be provided.

Referring to FIG. 23, the antenna apparatus of the present preferred embodiment is provided with the configuration of the antenna apparatus of the third preferred embodiment, and additionally, a stub conductor ST1 close to a first antenna portion, a stub conductor ST2 close to a second antenna portion, and/or a stub conductor ST3 provided between the first antenna portion and the second portion. In the present preferred embodiment, each of the stub conductors ST1, ST2 and ST3 is configured as a strip-shaped conductor. The stub conductor ST1 has a certain length L61, and is provided on a left side of a rectangular antenna element 1 so as to be located apart from a left bottom vertex of the antenna element 1 by a certain distance L62. The stub conductor ST2 has a certain length L63, and is provided on a right side of the rectangular antenna element 1 so as to be located apart from a right bottom vertex of the antenna element 1 by a certain distance L64. As shown in FIG. 23, for preventing the stub conductors ST1 and ST2 from protruding and being obstacle, the longitudinal direction of the stub conductor ST1 may be provided close to the left side of the antenna element 1 such that the longitudinal direction of the stub conductor ST1 is substantially parallel to the left side of the antenna element 1, and the longitudinal direction of the stub conductor ST2 may be provided close to the right side of the antenna element 1 such that the longitudinal direction of the stub conductor ST2 is substantially parallel to the right side of the antenna element 1. Furthermore, the stub conductor ST3 has a certain length L65, and is provided at a position on a side of the antenna element 1 opposing a ground conductor 2 (bottom side of the antenna element 1), where the stub conductor ST3 is positioned apart from a reference point P1*a* for the capacitive feeding of the first antenna portion by a distance L66, and apart from an opening of a slit 51 of the second antenna portion by a distance L67. For preventing the stub conductor ST3 from protruding and being an obstacle, in a similar manner to that of the stub conductors ST1 and ST2, the longitudinal direction of the stub conductor ST3 may be provided close to the bottom side of the antenna element 1 such that the longitudinal direction of the stub conductor ST1 is substantially parallel to the bottom side of the antenna element 1. The respective lengths L61, L63 and L65 of the stub conductors ST1, ST2 and ST3 are preferably determined to be equal to $(1/4+n/2)\lambda$, where $\lambda$ denotes a wavelength of radio signals transmitted and/or received by the antenna apparatus, and n denotes an integer greater than or equal to 0.

In the present preferred embodiment, when taking into account effect by the stub conductors ST1, ST2 and ST3, the electrical distance between feeding points P1 and P2 is a length of $(1/4+n/2)\lambda$, where $\lambda$ denotes a wavelength of radio signals transmitted and/or received by the antenna apparatus, and n denotes an integer greater than or equal to 0.

Although FIG. 23 shows that the feeding point P2 is positioned apart from the opening of the slit S1 by a distance L23, the present invention is not limited so, and the feeding point P2 can be provided at a desired position along the slit S1, as long as the feeding point P2 is provided at a position where the electrical distance between the feeding points P1 and P2 is the length of $(1/4+n/2)\lambda$.

The configuration, in which the stub conductors ST1, ST2 and ST3 are provided instead of the slit S2, may be applied to an antenna apparatus having two slits S1 and S2, such as the antenna apparatus in FIG. 18, alternatively, the configuration may be applied to an antenna apparatus having two capacitive feeding portions, such as the antenna apparatus in FIG. 19.

According to the antenna apparatus of the present preferred embodiment, at least one of the stub conductors ST1, ST2, and ST3 is provided for adjusting electromagnetic coupling between the first antenna portion and the second antenna portion, and accordingly, isolation between the first antenna portion and the second antenna portion is further improved over the case of the antenna apparatus of the third preferred embodiment. As such, in the antenna apparatus of the present preferred embodiment, it is possible to make the single antenna element 1 operate as two antenna portions such that the antenna element 1 is excited as the first antenna portion through the feeding point P1, and at the same time, the slit S1 is excited as the second antenna portion through the feeding point P2. Accordingly, while having a simple configuration, the antenna apparatus can simultaneously transmit and/or receive a plurality of radio signals with low correlation to each other.

Sixth Preferred Embodiment

Figure 24:
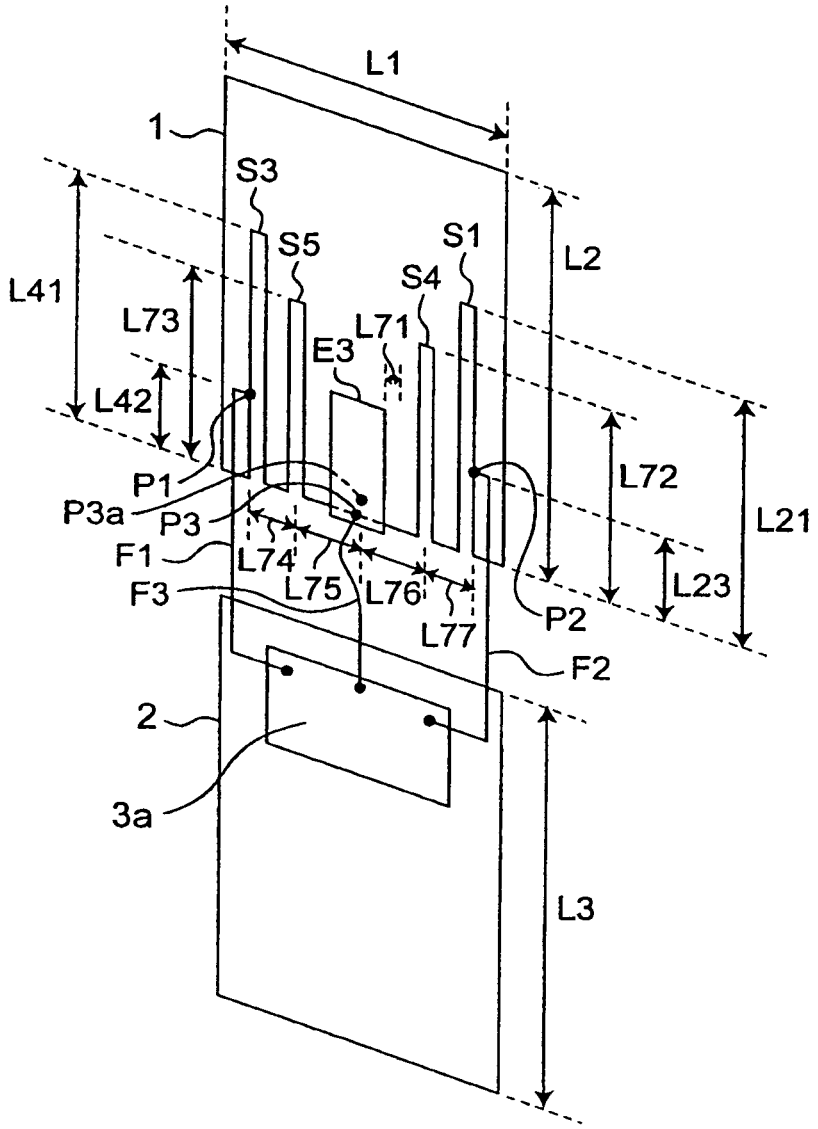
FIG. 24 is a perspective view showing a schematic configuration of an antenna apparatus according to a sixth preferred embodiment of the present invention.

FIG. 24 is a perspective view showing a schematic configuration of an antenna apparatus according to a sixth preferred embodiment of the present invention. According to the present invention, it is possible to make a single antenna element 1 operate as not only two antenna portions, but operate as three or more antenna portions. The present preferred embodiment is characterized in that an antenna element 1 is provided with three feeding points P1, P2 and P3, and the single antenna element 1 is made to operate as three antenna portions, by exciting the antenna element 1 as a first antenna portion through the feeding point P1, exciting the antenna element 1 as a second antenna portion through the feeding point P2, and at the same time, exciting the antenna element 1 as a second antenna portion through the feeding point P3.

Referring to FIG. 24, the antenna apparatus of the present preferred embodiment is provided with, on an antenna element 1, an electrode E3 which is made of a conductive plate and provided in parallel to the antenna element 1, instead of the slit S2 in FIG. 18. The electrode E3 is spaced from the antenna element 1 by a certain distance L71 through air or a certain dielectric material. Thus, in the antenna apparatus of the present preferred embodiment, a capacitor is formed by the electrode E3 and the antenna element 1, a third feeding point P3 is provided on the electrode E1, and the feeding point P3 is connected to a radio signal processor circuit 3*a* through a feed line F3. As with feed lines F1 and F2, the feed line F3 can be made of a coaxial cable having an impedance of 50Ω, and in this case, an inner conductor of the coaxial cable connects the feeding point P3 to the radio signal processor circuit 3*a*, and on the other hand, an outer conductor of the coaxial cable is connected to a ground conductor 2. The feeding point P3, the electrode E3, and a capacitor formed by the electrode E3 and the antenna element 1 configure a capacitive feeding portion for a third antenna portion. A radio signal is fed to the antenna element 1 through this capacitor, and thus, operates as the third antenna portion. The size of the electrode E3 is appropriately determined according to the frequency of radio signals transmitted and/or received by the antenna apparatus. Preferably, the size is determined such that the length in at least one direction of the electrode E3 (e.g., in the case of a rectangular electrode E3, the direction of a longitudinal side thereof) is $(1/4+n/2)$ where $\lambda$ denotes a wavelength of radio signals transmitted and/or received by the antenna apparatus, and n denotes an integer greater than or equal to 0. A point on the antenna element 1 that is closest to the feeding point P3 is regarded as a reference point P3*a* for the capacitive feeding.

The antenna apparatus of the present preferred embodiment further has a slit S4 for adjusting electromagnetic coupling, in the antenna element 1 and between the second antenna portion and the third antenna portion. The slit S4 has a certain width and a length L72, and one end of the slit S4 has, as an open end, an opening on a side of the antenna element 1 opposing the ground conductor 2. The antenna apparatus of the present preferred embodiment further has a slit S5 for adjusting electromagnetic coupling, in the antenna element 1 and between the first antenna portion and the third antenna portion. The slit S5 has a certain width and a length L73, and one end of the slit S5 has, as an open end, an opening on a side of the antenna element 1 opposing the ground conductor 2. The opening of the slit S4 is located apart from a reference point P3*a* for the capacitive feeding of the third antenna portion by a distance L76, and apart from an opening of a slit S1 of the second antenna portion by a distance L77. The opening of the slit S5 is located apart from an opening of a slit S3 of the first antenna portion by a distance L74, and apart from the reference point P3*a* of the third antenna portion of the capacitive feeding by a distance L75.

A distance L42+L74+2×L73+L75 between the feeding points P1 and P3 satisfies the following relation of expression (6):

$$L42+L74+2\times L73+L75=(1/4+n1/2)\lambda \quad (6),$$

where λ denotes a wavelength of radio signals transmitted and/or received by the antenna apparatus, and n1 denotes an integer greater than or equal to 0.

Although FIG. 24 shows that the feeding point P1 is positioned apart from the opening of the slit S3 by the distance 142, the present invention is not limited so, and the feeding point P1 can be provided at a desired position along the slit S3, as long as the position satisfies the expression (6) (i.e., 0≤L42<L41).

A distance L23+L77+2×L72+L76 between the feeding points P2 and P3 satisfies the following relation of expression (7):

$$L23+L77+2\times L72+L76=(1/4+n2/2)\lambda \quad (7),$$

where λ denotes a wavelength of radio signals transmitted and/or received by the antenna apparatus, and n2 denotes an integer greater than or equal to 0.

Although FIG. 24 shows that the feeding point P2 is positioned apart from the opening of the slit S1 by the distance L23, the present invention is not limited so, and the feeding point P2 can be provided at a desired position along the slit S1, as long as the position satisfies the expression (7) (i.e., 0≤L23<L21).

According to the antenna apparatus of the present preferred embodiment with the above-described configuration, while isolations between the antenna portions are ensured by the slits S4 and S5, the slit S3 is excited as the first antenna portion through the feeding point P1, the slit S1 is excited as the second antenna portion through the feeding point P2, and at the same time, the antenna element 1 is excited as the third antenna portion through the feeding point P3, and thus, it is possible to make the single antenna element 1 operate as three antenna portions. Accordingly, while having a simple configuration, the antenna apparatus can simultaneously transmit and/or receive a plurality of radio signals with low correlation to each other.

Figure 25:
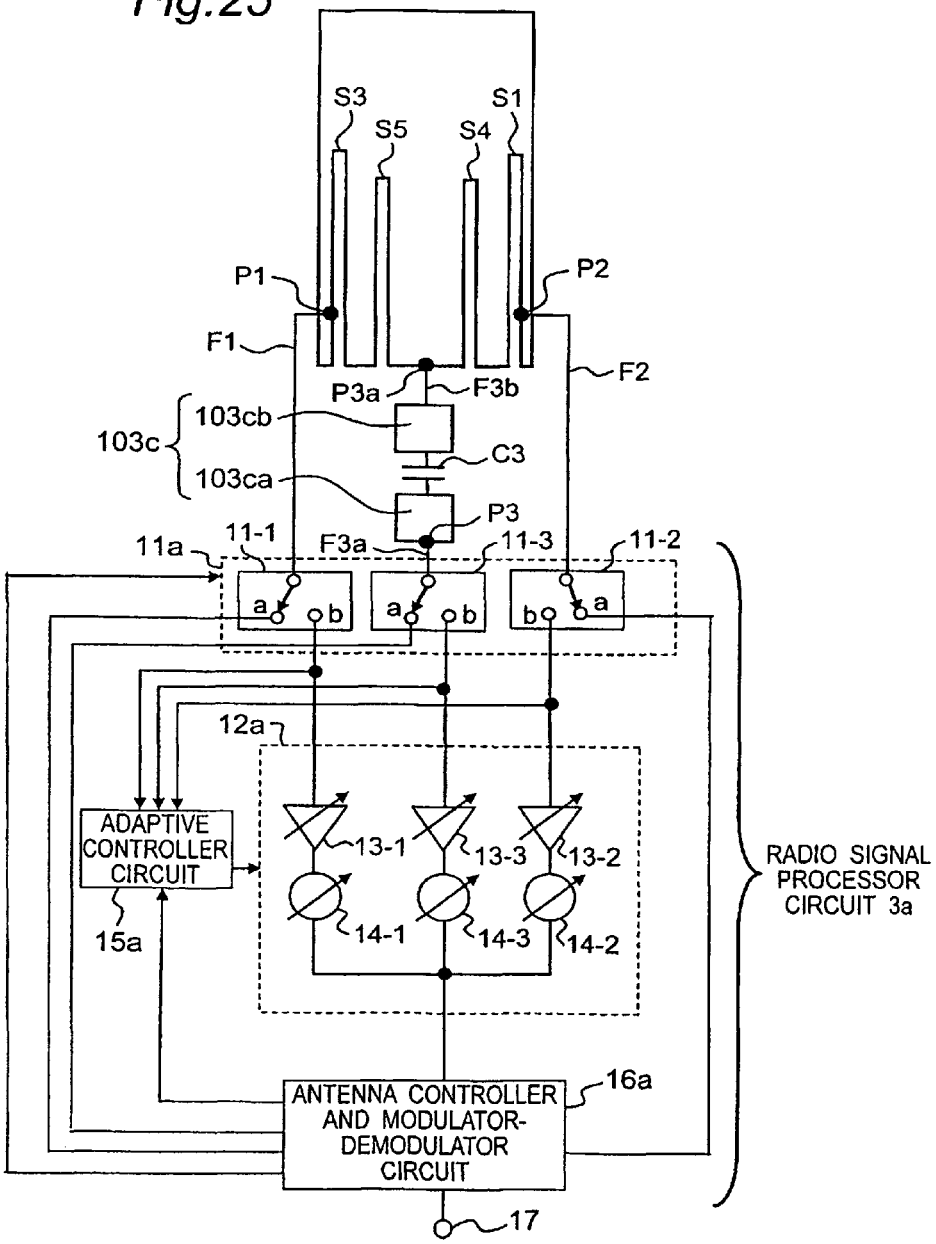
FIG. 25 is a block diagram showing a detailed configuration of a circuit of the antenna apparatus in FIG. 24.

FIG. 25 is a block diagram showing a detailed configuration of a circuit of the antenna apparatus in FIG. 24. The configuration of a radio signal processor circuit 3*a* is substantially the same as that of the radio signal processor circuit 3*a* in FIG. 2 and the others, except that the radio signal processor circuit 3*a* processes signals transmitted and/or received by three antenna portions. In FIG. 25, the feeding points P1 and P2 of the antenna element 1 are respectively connected, through feed lines F1 and F2, to switches 11-1 and 11-2 of a switch circuit 11*a* in the radio signal processor circuit 3*a*. A capacitive feeding portion of the third antenna portion is preferably provided within a central hinge portion 103*c*, as will be described in detail later with reference to FIGS. 26A and 26B. FIG. 25 shows that a space between conductive components 103*ca* and 103*cb* which configure the central hinge portion 103*c* (e.g., a space between the conductive components 103*ca* and 103*cb* spaced from each other by a dielectric) acts as a capacitor C3. A feed line F3 includes a first feed line F3*a*, the central hinge portion 103*c*, and a second feed line F3*b*. The reference point P3*a* for the capacitive feeding of the antenna element 1 is connected to the central hinge portion 103*c* through the second feed line F3*b*, and the feeding point P3 provided on the central hinge portion 103*c* is connected, through the first feed line F3*a*, to a switch 11-3 of the switch circuit 11*a* in the radio signal processor circuit 3*a*. The switch circuit 11*a* switches, under control of an antenna controller and modulator/demodulator circuit 16*a*, to either a state in which the antenna element 1 is directly connected to the antenna controller and modulator/demodulator circuit 16*a*, or a state in which the antenna element 1 is connected to the antenna controller and modulator/demodulator circuit 16*a* through an amplitude and phase controller circuit 12*a*. When the antenna element 1 is directly connected to the antenna controller and modulator/demodulator circuit 16*a*, the antenna controller and modulator/demodulator circuit 16*a* operates as a MIMO modulator/demodulator circuit, and transmits and/or receives radio signals of a plurality of channels (in the present preferred embodiment, three channels) using to a MIMO communication method through the antenna element 1. The antenna controller and modulator/demodulator circuit 16*a* may perform modulation or demodulation of three independent radio signals, instead of performing a MIMO modulation or demodulation, and in this case, the antenna apparatus of the present preferred embodiment can simultaneously perform wireless communications for a plurality of applications, or simultaneously perform wireless communications in a plurality of frequency bands. On the other hand, when the antenna element 1 is connected to the antenna controller and modulator/demodulator circuit 16*a* through the amplitude and phase controller circuit 12*a*, the amplitude and phase controller circuit 12*a* performs adaptive control on transmitted and/or received radio signals under control of an adaptive controller circuit 15*a*. The amplitude and phase controller circuit 12*a* includes amplitude adjusters 13-1, 13-2 and 13-3, and phase shifters 14-1, 14-2 and 14-3. Upon reception, each of signals received and respectively passed through the switches 11-1, 11-2 and 11-3 is inputted to the amplitude and phase controller circuit 12*a* and inputted to the adaptive controller circuit 15*a*. Preferably, for the purpose of maximum ratio combining, the adaptive controller circuit 15*a* determines the amounts of changes in amplitudes and amounts of phase shifts of the signals based on the inputted received signals, changes the amplitude and phase of the signal passed through the switch 11-1, by means of the amplitude adjuster 13-1 and the phase shifter 14-1, changes the amplitude and phase of the signal passed through the switch 11-2, by means of the amplitude adjuster 13-2 and the phase shifter 14-2, and changes the amplitude and phase of the signal passed through the switch 11-3, by means of the amplitude adjuster 13-3 and the phase shifter 14-3. The received signals whose amplitudes and phases have been changed are combined with each other, and the combined signal is inputted to the antenna controller and modulator/demodulator circuit 16*a*. Upon transmission, in order to direct a beam in a desired direction, the adaptive controller circuit 15*a* determines the amounts of changes in amplitudes and amounts of phase shifts of signals to be transmitted under control of the antenna controller and modulator/demodulator circuit 16*a*, and according to this determination, makes the amplitude and phase controller circuit 12*a* change the amplitudes and phases of the signals to be transmitted. The antenna controller and modulator/demodulator circuit 16*a* is connected, through an input/output terminal 17 of the radio signal processor circuit 3*a*, to further circuits (not shown) in a wireless communication apparatus including an antenna apparatus of the present preferred embodiment.

Figure 26A:
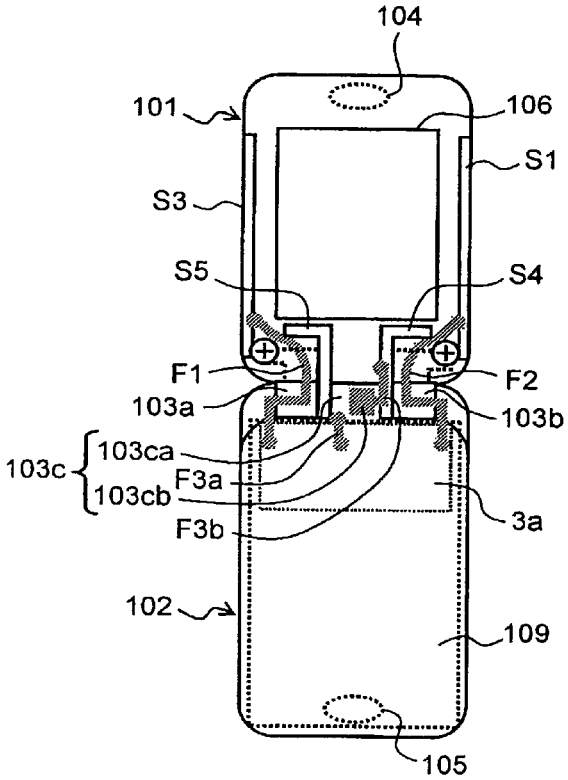
FIG. 26A is a front view of a mobile phone showing an exemplary implementation of the antenna apparatus in FIG. 24.
Figure 26B:
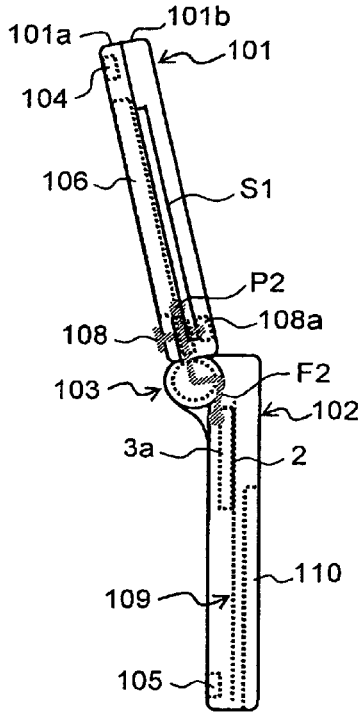
FIG. 26B is a side view of the mobile phone showing the exemplary implementation of the antenna apparatus in FIG. 24.

FIG. 26A is a front view of a mobile phone showing an exemplary implementation of the antenna apparatus in FIG. 24, and FIG. 26B is a side view thereof. In the present exemplary implementation, in a similar manner to those of the exemplary implementations in FIGS. 4A, 4B, 8A, 8B, 8C, 8D, 12A, 12B, 16A, 16B and 16C, each of a first upper housing portion 101*a* and a second upper housing portion 101*b* is made of a conductor, and a slit S1, a feeding point P2, and a feed line F2 of a second antenna portion are configured in the same manner as in the exemplary implementations in FIGS. 12A, 12B, 16A, 16B and 16C. A slit S3 of a first antenna portion is configured in the same manner as the slit S1, and is provided in a left side surface of an upper housing 101 and between the first upper housing portion 101*a* and the second upper housing portion 101*b*. For the purpose of configuring a lower end of the slit S3 (i.e., an end of the slit S3 on the side close to a hinge portion 103) as an open end, a portion of the hinge portion 103 opposing the lower end of the slit S3 is preferably made as empty space or be made of a dielectric material. A feeding point P1 is provided at a position upward from the lower end of the slit S3 by a certain distance, and the feeding point P1 extends to a lower housing 102 through a feed line F1, and then, is connected to a radio signal processor circuit 3*a*. A central hinge portion 103*c* includes a cylindrical portion 103*ca* mechanically connected to the lower housing 102, and a cylindrical inner conductor 103*cb* inserted into the cylindrical portion 103*ca* in a rotatable manner. Each of the cylindrical portion 103*ca* and the inner conductor 103*cb* is made of a conductive material such as aluminum or zinc. At least one of the inner side of the cylindrical portion 103*ca* and the outer side of the inner conductor 103*cb* is coated by a dielectric, and thus, when the inner conductor 103*cb* is inserted into the cylindrical portion 103*ca*, a capacitor C3 of FIG. 25 is formed between the inner side surface of the cylindrical portion 103*ca* and the outer side surface of the inner conductor 103*cb*. The radio signal processor circuit 3*a* is connected to the cylindrical portion 103*ca* through a first feed line F3*a* made of a coaxial cable or the like, and the inner conductor 103*cb* is connected to the first upper housing portion 101*a* through a second feed line F3*b* made of a coaxial cable or the like. In the present exemplary implementation, a point at which the first feed line F3*a* is connected to the cylindrical portion 103*ca* is regarded as a feeding point P3*a*, and a point at which the second feed line F3*b* is connected to the first upper housing portion 101*a* is regarded as a reference point P3*a* for the capacitive feeding. Furthermore, a slit S5 is formed in a portion of the first upper housing portion 101*a* opposing the hinge portion 103 so as to be located between the first antenna portion (i.e., the slit S3 and the feeding point P1) and a point at which the second feed line F3*b* is connected to the first upper housing portion 101*a* (the reference point P3*a* for the capacitive feeding). Similarly, a slit S4 is formed in a portion of the first upper housing portion 101*a* opposing the hinge portion 103 so as to be located between the second antenna portion (i.e., the slit S1 and the feeding point P2) and a point at which the second feed line F3*b* is connected to the first upper housing portion 101*a* (the reference point P3*a* for the capacitive feeding). In the present exemplary implementation, for ensuring the length L72 of the slit S4 and the length L73 of the slit S5, each of the slits S4 and S5 is configured as an L-shaped slit, but is not limited to this shape. For the purpose of configuring a lower end of each of the slits S4 and S5 is an open end, a portion of the hinge portion 103 opposing the lower ends of the slits S4 and S5 is preferably made as empty space or be made of a dielectric material. The spaces inside the slits S1, S3, S4 and S5 are preferably filled by a dielectric material, for mechanical reinforcement. Thus, the upper housing 101 operates as an antenna element 1 in FIGS. 24 and 25.

As an exemplary implementation of the present preferred embodiment, a mobile phone may be configured such that, in a similar manner to those of the exemplary implementations in FIGS. 5A, 5B, 9A, 9B, 13A, 13B, 17A, 17B and 17C, each of a first upper housing portion 101*a* and a second upper housing portion 101*b* is made of a dielectric, an antenna element 1 made of a rectangular conductive plate is provided within an upper housing 101, the antenna element 1 has slits S1, S3, S4 and S5, and an inner conductor 103*cb* is connected to the antenna element 1 through a feed line F3*a*.

As shown in FIGS. 24, 25, 26A and 26B, instead of a configuration including one capacitive feeding portion (electric current antenna) and two magnetic current antennas, it is also possible to adopt a configuration including two capacitive feeding portions and one magnetic current antenna, or a configuration including the other combination of other numbers of electric current antennas and magnetic current antennas. Further, for the purpose of adjusting electromagnetic coupling, stub conductors such as those described in the fifth preferred embodiment may be provided, instead of the slits S4 and S5.

As described above, according to the antenna apparatus of the present preferred embodiment, it is possible to make the single antenna element 1 operate as three antenna portions, accordingly, while having a simple configuration, the antenna apparatus can simultaneously transmit and/or receive a plurality of radio signals with low correlation to each other.

Seventh Preferred Embodiment

Figure 27:
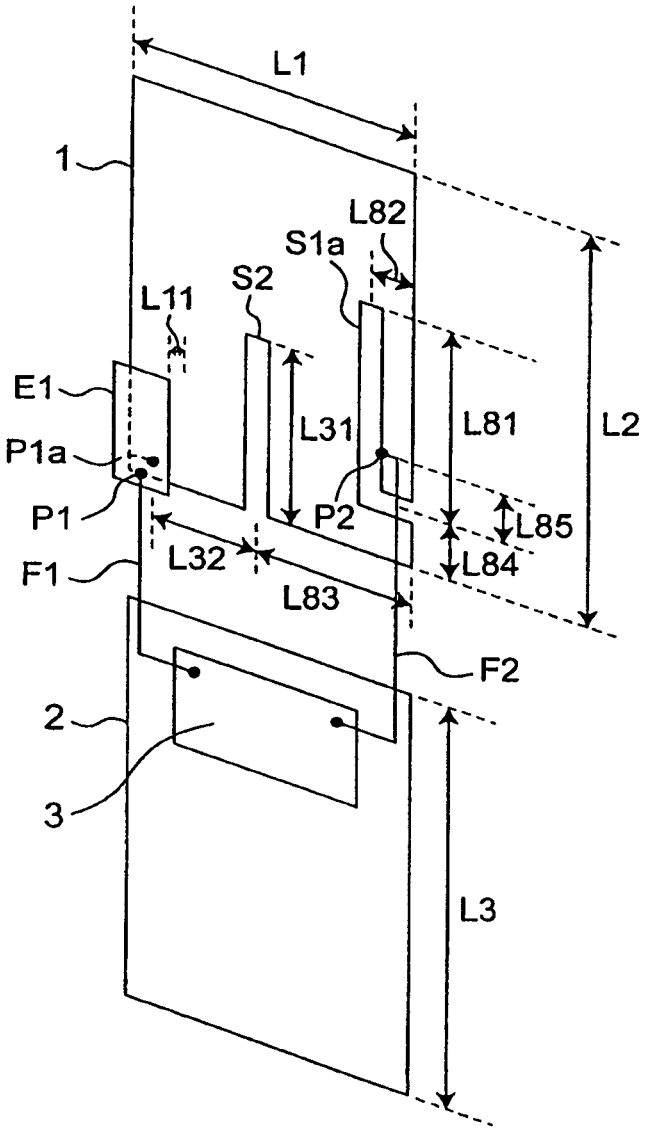
FIG. 27 is a perspective view showing a schematic configuration of an antenna apparatus according to a seventh preferred embodiment of the present invention.

FIG. 27 is a perspective view showing a schematic configuration of an antenna apparatus according to a seventh preferred embodiment of the present invention. The slit S1 of the second antenna portion is not limited to a configuration in which, as in the third and fourth preferred embodiments, the slit S1 has an opening at a side opposing the ground conductor 2, and alternatively, the slit S1 may have an opening at a different position of an antenna element 1. The antenna apparatus of the present preferred embodiment is characterized in that an L-shaped slit S1*a* is formed as a second antenna portion, instead of a linear slit S1 in the fourth preferred embodiment, and the slit S1*a* has an opening on a left side of an antenna element 1.

In FIG. 27, the slit S1*a* is configured as an L-shaped slit having a first portion with a length L81 extending in an up/down direction in the drawing, and a second portion with a length L82 extending in a left/right direction in the drawing. The opening of the slit S1*a* is provided at a position proceeding upward from a right bottom end of the antenna element 1 by a distance L84. A feeding point P2 of the slit S1*a* is provided at a position proceeding by a distance L85 from the bend between the second portion (left/right direction portion) and the first portion (up/down direction portion) of the slit S1*a*. In the present preferred embodiment, an opening of a slit S2 is located at a position proceeding leftward from a right bottom end of the antenna element 1 by a distance L83.

A distance L32+2×L31+L83+L84+L82+L85 between the feeding points P1 and P2 satisfies the following relation of expression (8):

$$L32+2\times L31+L83+L84+L82+L85=(1/4+n/2)\lambda \quad (8),$$

where λ denotes a wavelength of radio signals transmitted and/or received by the antenna apparatus, and n denotes an integer greater than or equal to 0.

It is also possible to adopt a configuration in which a slit S2 is not formed, as in the third preferred embodiment, and in this case, a distance L32+L83+L84+L82+L85 between the feeding points P1 and P2 satisfies the following relation of expression (9):

$$L32+L83+L84+L82+L85=(1/4+n/2)\lambda \quad (9),$$

where λ denotes a wavelength of radio signals transmitted and/or received by the antenna apparatus, and n denotes an integer greater than or equal to 0.

Although FIG. 27 shows that the feeding point P2 is positioned apart from the opening of the slit S1*a* by a distance L85+L82, the present invention is not limited so, and the feeding point P2 can be provided at a desired position along the slit S1*a*, as long as the position satisfies the expression (8) or (9).

Accordingly, in the antenna apparatus of the present preferred embodiment, the distance between the feeding points P1 and P2 is configured according to the expression (8) or (9), and thus, it is possible to make the single antenna element 1 operate as two antenna portions such that the antenna element 1 is excited as the first antenna portion through the feeding point P1, and at the same time, the slit S1*a* is excited as the second antenna portion through the feeding point P2. Accordingly, while having a simple configuration, the antenna apparatus can simultaneously transmit and/or receive a plurality of radio signals with low correlation to each other.

Eighth Preferred Embodiment

Figure 28:
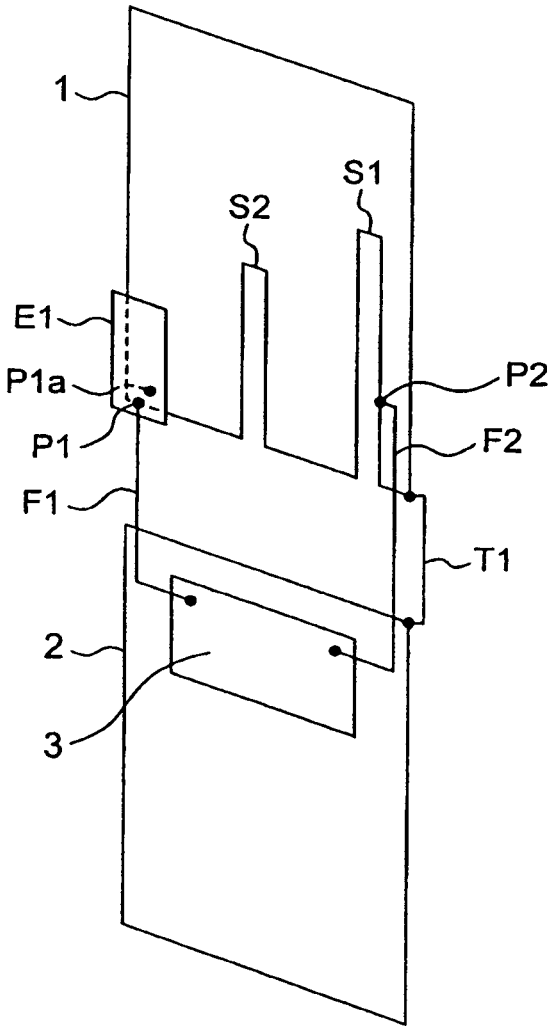
FIG. 28 is a perspective view showing a schematic configuration of an antenna apparatus according to an eighth preferred embodiment of the present invention.

FIG. 28 is a perspective view showing a schematic configuration of an antenna apparatus according to an eighth preferred embodiment of the present invention. In the antenna apparatuses according to the above-described first to seventh preferred embodiments, it is also possible to adopt a configuration in which an antenna element 1 is electrically connected to a ground conductor 2. The antenna apparatus of FIG. 28 is characterized in that in the antenna apparatus of the fourth preferred embodiment, the right bottom end of the antenna element 1 and the right top end of the ground conductor 2, which are opposed to each other, are connected by a short-circuit conductor T1.

Figure 29A:
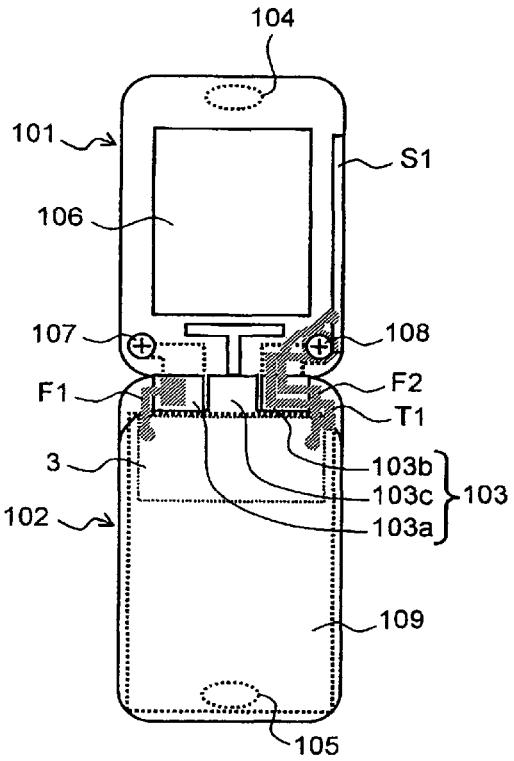
FIG. 29A is a front view of a mobile phone showing an exemplary implementation of the antenna apparatus in FIG. 28.
Figure 29B:
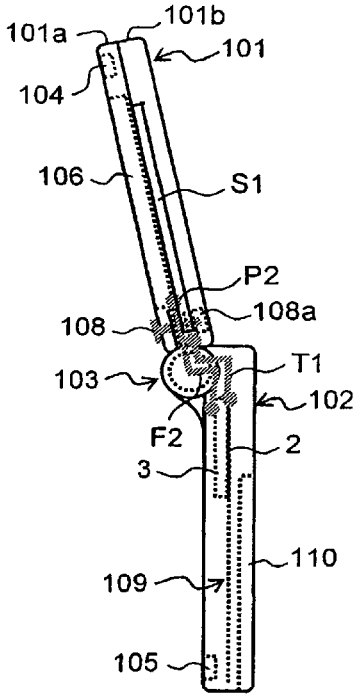
FIG. 29B is a side view of the mobile phone showing the exemplary implementation of the antenna apparatus in FIG. 28.

FIG. 29A is a front view of a mobile phone showing an exemplary implementation of the antenna apparatus in FIG. 28, and FIG. 29B is a side view thereof. The short-circuit conductor T1 is made of, for example, a coaxial cable or conductive wire, and extends from a ground conductor 2 formed on one side of a printed wiring board 109 within a lower housing 102 to an upper housing 101 through a right hinge portion 103*b*, and then, is electrically connected to a right bottom portion of a first upper housing portion 101*a* by a screw 108. In the case that the lower housing 102 is made of a conductor, the short-circuit conductor T1 is connected to the lower housing 102, instead of connected to the printed wiring board 109.

According to the present preferred embodiment, an effect equivalent to Γ-matching can be obtained by connecting the antenna element 1 with the ground conductor 2, and therefore, the radiation characteristics of the antenna apparatus can be improved. Furthermore, since the antenna element 1 is connected with the ground conductor 2 by the short-circuit conductor T1, the ground for, e.g., a display 106 and/or a camera (not shown) disposed in the upper housing 101 can be enhanced, therefore, for example, an effect of preventing malfunction of a mobile phone due to static electricity can be expected.

As described above, according to the antenna apparatus of the present preferred embodiment, it is possible to make the single antenna element 1 operate as two antenna portions, accordingly, while having a simple configuration, the antenna apparatus can simultaneously transmit and/or receive a plurality of radio signals with low correlation to each other.

Modified Preferred Embodiment

The exemplary implementations of the antenna apparatuses according to the preferred embodiments of the present invention are not limited to a mobile phone, and any other apparatus having a wireless communication function can be configured. For example, it is possible to configure a laptop personal computer, a handheld personal computer, a mobile phone which is not of a foldable type, other portable terminal apparatuses, or the like, having the antenna apparatuses according to the preferred embodiments. In the case that the antenna apparatuses according to the respective preferred embodiments are provided on a laptop personal computer, the personal computer includes an upper housing and a lower housing which are connected to each other by a hinge portion, and in such personal computer, it is possible to make the upper housing of a conductive plate such that the upper housing operates as an antenna element 1. When providing a laptop personal computer with a capacitive feeding portion, the configuration is not limited to one in which a capacitor is provided within a hinge portion of the personal computer, and alternatively, an electrode spaced from an upper housing by a certain distance may be provided (e.g., see FIG. 10). The size of the electrode is preferably determined such that the length in at least one direction of the electrode (e.g., in the case of a rectangular electrode, the direction of a longitudinal side thereof) is (¼+n/2)λ, where λ denotes a wavelength of radio signals transmitted and/or received by the antenna apparatus, and n denotes an integer greater than or equal to 0.

Figure 30:
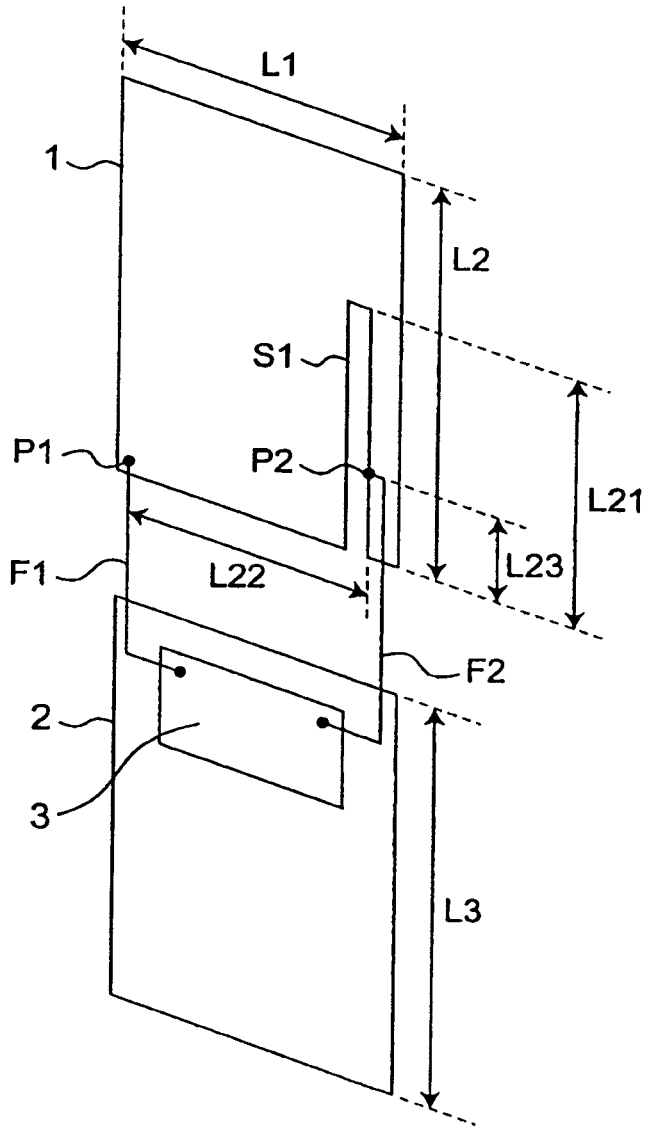
FIG. 30 is a perspective view showing a schematic configuration of an antenna apparatus according to a modified preferred embodiment of the third preferred embodiment of the present invention.
Figure 31:
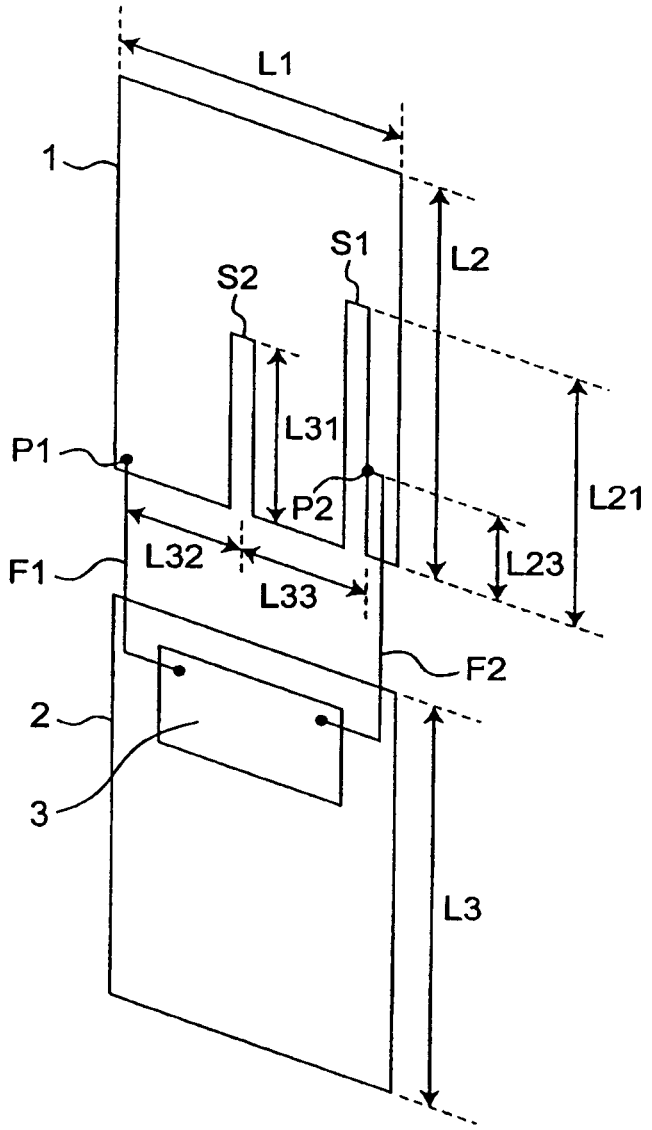
FIG. 31 is a perspective view showing a schematic configuration of an antenna apparatus according to a third modified preferred embodiment of the fourth preferred embodiment of the present invention.
Figure 32:
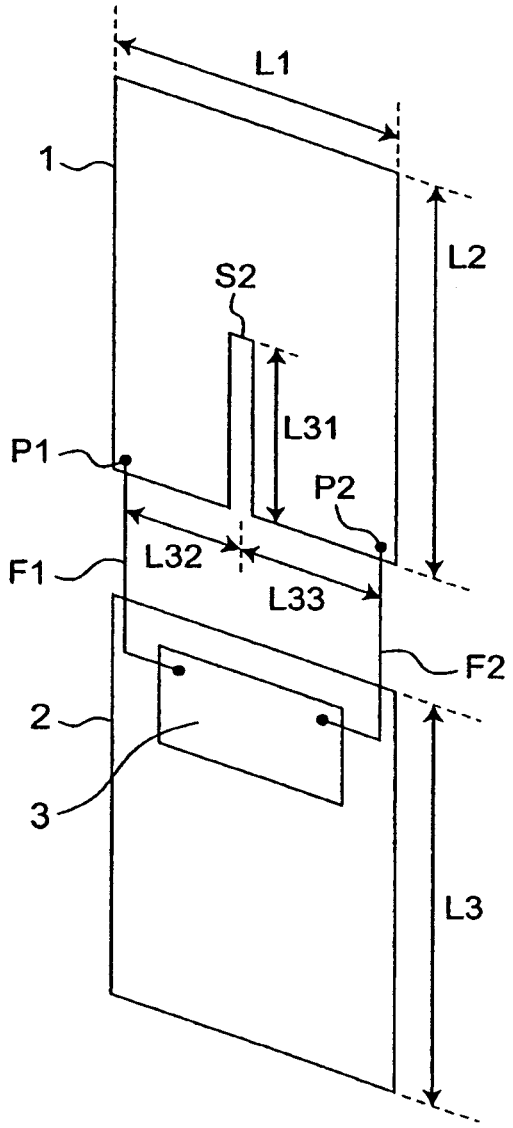
FIG. 32 is a perspective view showing a schematic configuration of an antenna apparatus according to a fourth modified preferred embodiment of the fourth preferred embodiment of the present invention.
Figure 33:
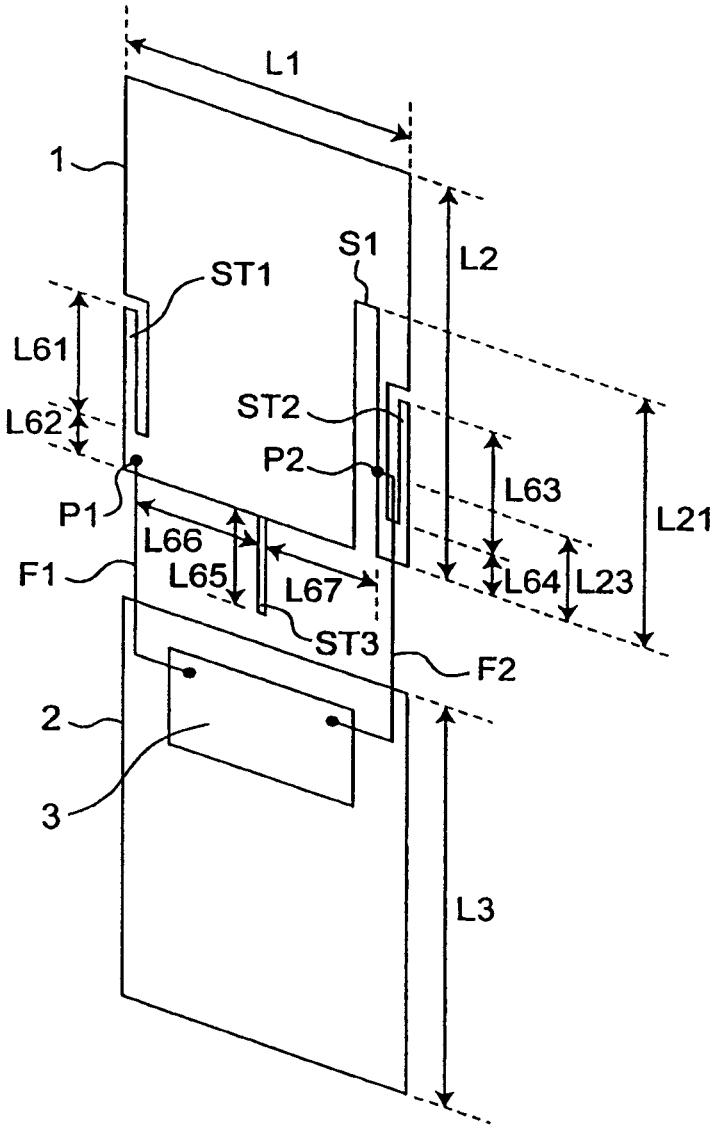
FIG. 33 is a perspective view showing a schematic configuration of an antenna apparatus according to a first modified preferred embodiment of the fifth preferred embodiment of the present invention.
Figure 34:
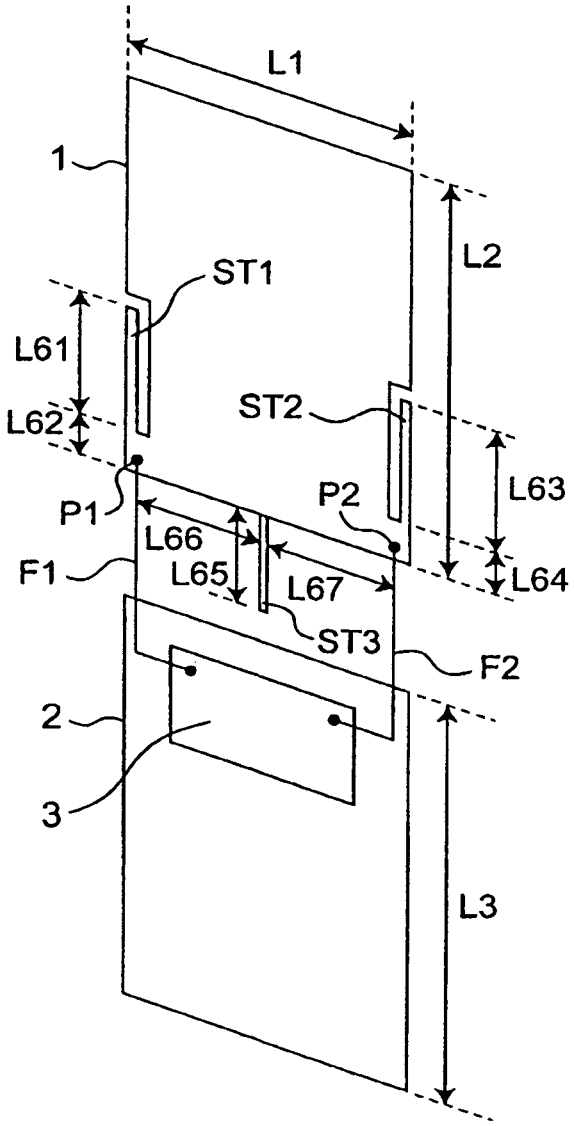
FIG. 34 is a perspective view showing a schematic configuration of an antenna apparatus according to a second modified preferred embodiment of the fifth preferred embodiment of the present invention.
Figure 35:
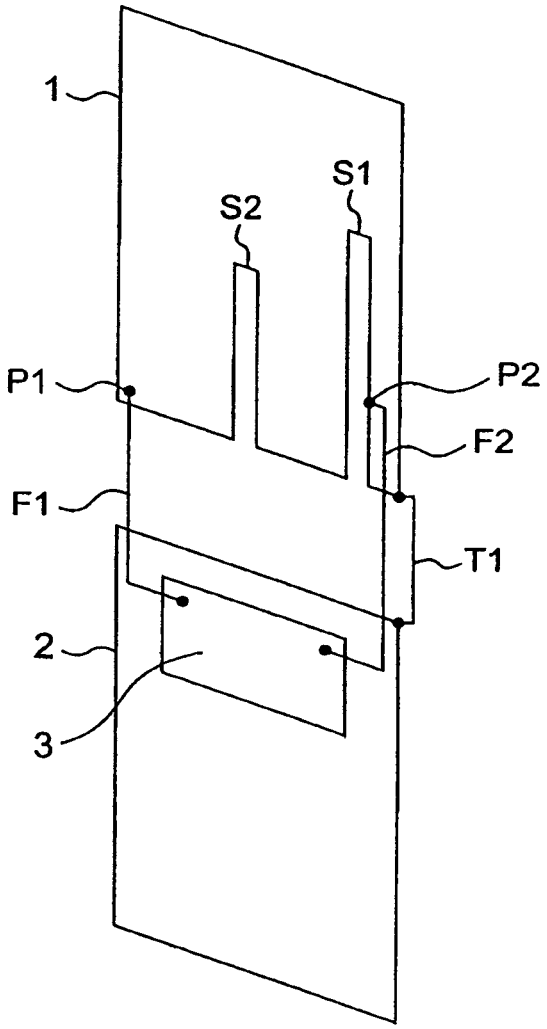
FIG. 35 is a perspective view showing a schematic configuration of an antenna apparatus according to a first modified preferred embodiment of the eighth preferred embodiment of the present invention.
Figure 36:
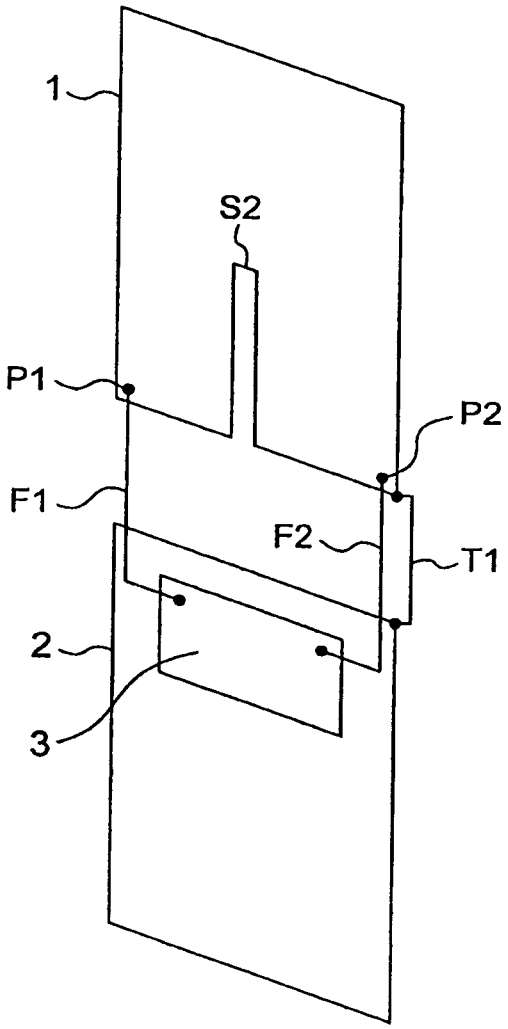
FIG. 36 is a perspective view showing a schematic configuration of an antenna apparatus according to a second modified preferred embodiment of the eighth preferred embodiment of the present invention.

A further configuration may be adopted in which the configurations in the above-described respective preferred embodiments are combined. For example, when a first antenna portion is made to operate as an electric current antenna and a second antenna portion is made to operate as a magnetic current antenna, a radio signal may be fed directly to the first antenna portion, instead of being capacitively fed, as shown in FIGS. 30, 31, 33 and 35 without through a capacitor. FIG. 30 is a perspective view showing a schematic configuration of an antenna apparatus according to a modified preferred embodiment of the third preferred embodiment of the present invention. FIG. 31 is a perspective view showing a schematic configuration of an antenna apparatus according to a third modified preferred embodiment of the fourth preferred embodiment of the present invention. FIG. 33 is a perspective view showing a schematic configuration of an antenna apparatus according to a first modified preferred embodiment of the fifth preferred embodiment of the present invention. FIG. 35 is a perspective view showing a schematic configuration of an antenna apparatus according to a first modified preferred embodiment of the eighth preferred embodiment of the present invention. Furthermore, when a slit for adjusting electromagnetic coupling is formed between a first antenna portion and a second antenna portion, different antenna radiation methods (an electric current antenna and a magnetic current antenna) need not to be used, and accordingly, both antenna portions may be made to operate as magnetic current antennas as shown in FIG. 18, or operate as electric current antennas (capacitive feeding) as shown in FIG. 19, or alternatively, operate as electric current antennas to which radio signals are directly fed as shown in FIGS. 32, 34 and 36. FIG. 32 is a perspective view showing a schematic configuration of an antenna apparatus according to a fourth modified preferred embodiment of the fourth preferred embodiment of the present invention. FIG. 34 is a perspective view showing a schematic configuration of an antenna apparatus according to a second modified preferred embodiment of the fifth preferred embodiment of the present invention. FIG. 36 is a perspective view showing a schematic configuration of an antenna apparatus according to a second modified preferred embodiment of the eighth preferred embodiment of the present invention. According to the modified preferred embodiments in FIGS. 30 to 36, in a similar manner to that of the configuration described earlier, it is possible to make the single antenna element 1 operate as two antenna portions, accordingly, while having a simple configuration, the antenna apparatus can simultaneously transmit and/or receive a plurality of radio signals with low correlation to each other. As further modified preferred embodiments, the short-circuit conductor T1 of the eighth preferred embodiment may be provided to the antenna apparatus of the first preferred embodiment etc.

As described above, the antenna apparatuses of the preferred embodiments according to the present invention can simultaneously transmit and/or receive a plurality of radio signals with low correlation to each other, while having a simple configuration. Accordingly, it becomes possible, for example, to transmit and/or receive radio signals of a plurality of channels using a MIMO communication method, to simultaneously perform wireless communications for a plurality of applications, or to simultaneously perform wireless communications in a plurality of frequency bands.

According to the antenna apparatuses of the preferred embodiments according to the present invention, while achieving a thin and small-sized antenna apparatus by reducing the number of antenna elements, it is possible to improve the spatial correlation by ensuring the isolation between a plurality of antenna portions, and implementing the polarization diversity in radio signals transmitted and/or received by the plurality of antenna portions. In addition, according to the present antenna apparatuses, even when using a single antenna element, it is possible to simultaneously transmit and/or receive a plurality of radio signals without the need for a time division process or the like.

As described above, in the antenna apparatuses according to the preferred embodiments of the present invention, a MIMO operation is enabled by exciting a single antenna element 1 through a plurality of feeding points simultaneously, as well as ensuring the isolation between antenna portions (or isolation between the feeding points). As specific methods adapted for ensuring the isolation include: to adjust an electric length such that the spatial phase difference between the feeding points is an odd multiple of ¼ wavelength, to use voltage feeding and current feeding, and to use an electric current antenna system and a magnetic current antenna system. Furthermore, a MIMO operation with higher performance is enabled by ensuring the isolation between the feeding points by means of a slit formed between the feeding points for adjusting electromagnetic coupling.

The antenna apparatus and wireless communication apparatus of the present invention can be implemented, for example, as a mobile phone or as a wireless LAN apparatus. The present antenna apparatus can be mounted, for example, on a wireless communication apparatus for performing a MIMO communication, but not limited to MIMO, and can be mounted on a wireless communication apparatus capable of simultaneously performing communications for a plurality of applications (multi-applications).

As described above, although the present invention is described in detail with reference to preferred embodiments, the present invention is not limited to such embodiments. It will be obvious to those skilled in the art that numerous modified preferred embodiments and altered preferred embodiments are possible within the technical scope of the present invention as defined in the following appended claims.

What is claimed is:

1. An antenna apparatus comprising:

an antenna element, which is a single conductor plate;

an excitation slit disposed in said antenna element;

a first feeding point and a second feeding point disposed at first and second positions, respectively, on said antenna element, and being connected to a radio signal processor circuit through a first feed line and a second feed line, respectively, said second feeding point being disposed at said excitation slit; and a ground conductor plate spaced from said antenna element by a predetermined distance, wherein said antenna element is a planar antenna configured to be excited through said first feeding point, wherein said excitation slit is a slit antenna configured to be excited through said second feeding point, said excitation slit having an open end located at a side of said antenna element facing said ground conductor plate, wherein said planar antenna and said slit antenna are configured to be simultaneously excited through said first and second feeding points, respectively, and wherein said antenna element comprises an electromagnetic coupling adjuster disposed between said first and second feeding points, and being configured to generate an amount of isolation between said planar antenna and said slit antenna.

2. The antenna apparatus as claimed in claim 1, wherein said electromagnetic coupling adjuster is a non-excitation slit disposed in said antenna element.

3. The antenna apparatus as claimed in claim 1, wherein said electromagnetic coupling adjuster is a stub conductor disposed to said antenna element.

4. The antenna apparatus as claimed in claim 1, wherein said antenna element is configured to be excited as an electric current antenna through said first feeding point, and simultaneously, said excitation slit is configured to be excited as a magnetic current antenna through said second feeding point.

5. The antenna apparatus as claimed in claim 1, wherein when said antenna element is excited as an electric current antenna, a radio signal is fed to said antenna element through a capacitor.

6. The antenna apparatus as claimed in claim 1, wherein said first and second feeding points are disposed on said antenna element so as to be spatially spaced apart from each other by an odd multiple of ¼ wavelength of radio signals transmitted and/or received by said antenna apparatus.

7. The antenna apparatus as claimed in claim 1, wherein said antenna apparatus is configured for at least one of transmitting and receiving a plurality of different radio signals by exciting said antenna element through said first and second feeding points simultaneously.

8. The antenna apparatus as claimed in claim 7, wherein the plurality of different radio signals are a plurality of channel signals transmitted and received using a MIMO communication method.

9. The antenna apparatus as claimed in claim 1, wherein said ground conductor plate is connected to said antenna element through a short-circuit conductor.

10. The antenna apparatus as claimed in claim 1, wherein said electromagnetic coupling adjuster is located at said side of said antenna element facing said ground conductor plate.

11. The antenna apparatus as claimed in claim 10, wherein said electromagnetic coupling adjuster is a non-excitation slit disposed in said antenna element and having an open end located at said side of said antenna element facing said ground conductor plate.

12. The antenna apparatus as claimed in claim 10, wherein said electromagnetic coupling adjuster is a stub conductor disposed to said antenna element and located at said side of said antenna element facing said ground conductor plate.

13. A wireless communication apparatus for at least one of transmitting and receiving a plurality of radio signals using an antenna apparatus, said antenna apparatus comprising:

an antenna element, which is a single conductor plate;

an excitation slit formed in said antenna element;

a first feeding point and a second feeding point disposed at first and second positions, respectively, on said an antenna element, and being connected to a radio signal processor circuit through a first feed line and a second feed line, respectively, said second feeding point being disposed at said excitation slit; and a ground conductor plate spaced from said antenna element by a predetermined distance, wherein said antenna element is a planar antenna configured to be excited through said first feeding point, wherein said excitation slit is a slit antenna configured to be excited through said second feeding point, said excitation slit having an open end located at a side of said antenna element facing said ground conductor plate, wherein said planar antenna and said slit antenna are configured to be simultaneously excited through said first and second feeding points, respectively, and wherein said antenna element comprises an electromagnetic coupling adjuster between said first and second feeding points, and being configured to generate an amount of isolation between said planar antenna and said slit antenna.

14. The wireless communication apparatus as claimed in claim 13, wherein said electromagnetic coupling adjuster is located at said side of said antenna element facing said ground conductor plate.

15. The wireless communication apparatus as claimed in claim 14, wherein said electromagnetic coupling adjuster is a non-excitation slit disposed in said antenna element and having an open end located at said side of said antenna element facing said ground conductor plate.

16. The wireless communication apparatus as claimed in claim 14, wherein said electromagnetic coupling adjuster is a stub conductor disposed to said antenna element and located at said side of said antenna element facing said ground conductor plate.

* * * * *